US009370930B2

(12) United States Patent
Horikawa et al.

(10) Patent No.: US 9,370,930 B2
(45) Date of Patent: Jun. 21, 2016

(54) NOZZLE TESTING DEVICE AND IMAGE FORMING APPARATUS

(71) Applicants: Daisaku Horikawa, Kanagawa (JP); Nobuyuki Satoh, Kanagawa (JP); Mamoru Yorimoto, Kanagawa (JP); Kenji Morita, Tokyo (JP); Masayuki Fujii, Kanagawa (JP); Suguru Yokozawa, Kanagawa (JP); Masahiro Hiranuma, Kanagawa (JP); Yuichi Sakurada, Tokyo (JP); Tomohiro Sasa, Kanagawa (JP); Masaya Kawarada, Kanagawa (JP)

(72) Inventors: Daisaku Horikawa, Kanagawa (JP); Nobuyuki Satoh, Kanagawa (JP); Mamoru Yorimoto, Kanagawa (JP); Kenji Morita, Tokyo (JP); Masayuki Fujii, Kanagawa (JP); Suguru Yokozawa, Kanagawa (JP); Masahiro Hiranuma, Kanagawa (JP); Yuichi Sakurada, Tokyo (JP); Tomohiro Sasa, Kanagawa (JP); Masaya Kawarada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/753,729

(22) Filed: Jun. 29, 2015

(65) Prior Publication Data

US 2015/0375498 A1 Dec. 31, 2015

(30) Foreign Application Priority Data

Jun. 30, 2014 (JP) ..... 2014-134119
May 26, 2015 (JP) ..... 2015-106752

(51) Int. Cl.
*B41J 2/045* (2006.01)
*B41J 2/165* (2006.01)

(52) U.S. Cl.
CPC ..... *B41J 2/16579* (2013.01)

(58) Field of Classification Search
CPC .. B41J 2/04563; B41J 2/0458; B41J 2/04581; B41J 2/04591; B41J 29/393
USPC ..... 347/9, 12, 14, 19, 20
See application file for complete search history.

(56) References Cited

U.S. PATENT DOCUMENTS

2005/0046658 A1* 3/2005 Kojima ..... B41J 2/2139 347/19
2009/0184993 A1 7/2009 Yorimoto et al.

(Continued)

FOREIGN PATENT DOCUMENTS

JP 2005-22218 1/2005
JP 2009-166398 7/2009

(Continued)

OTHER PUBLICATIONS

U.S. Appl. No. 14/551,215, filed Nov. 24, 2014.

(Continued)

*Primary Examiner* — Manish S Shah
*Assistant Examiner* — Roger W Pisha, II
(74) *Attorney, Agent, or Firm* — Oblon, McClelland, Maier & Neustadt, L.L.P.

(57) ABSTRACT

A nozzle testing device includes: a two-dimensional image sensor to capture an image of a pattern formed on a recording object by discharging ink from a nozzle row while moving the nozzle row and the recording object relative to each other in a direction orthogonal to the nozzle row; a light source unit provided such that regularly reflected light by the pattern forms a regular reflection area in the image of the pattern captured by the two-dimensional image sensor; and a detection unit to analyze the image to detect discharge failure of the nozzles. The regular reflection area is formed in the image such that a dimension in a direction corresponding to the direction of relative movement between the nozzle row and the recording object is greater than a dimension in a direction orthogonal to the direction corresponding to the direction of relative movement in the image.

10 Claims, 15 Drawing Sheets

(56) References Cited

U.S. PATENT DOCUMENTS

| | | | | |
|---|---|---|---|---|
| 2011/0141182 | A1* | 6/2011 | Murray | B41J 11/0095 347/19 |
| 2012/0069411 | A1* | 3/2012 | Satoh | H04N 1/6044 358/504 |
| 2012/0194588 | A1* | 8/2012 | Kasai | B41J 2/2142 347/14 |
| 2012/0236308 | A1 | 9/2012 | Satoh | |
| 2013/0027720 | A1 | 1/2013 | Satoh | |
| 2013/0027721 | A1 | 1/2013 | Kobayashi et al. | |
| 2013/0135484 | A1 | 5/2013 | Satoh et al. | |
| 2013/0208289 | A1 | 8/2013 | Satoh et al. | |
| 2013/0229671 | A1 | 9/2013 | Yokozawa et al. | |
| 2013/0242319 | A1 | 9/2013 | Suzuki et al. | |
| 2013/0242320 | A1 | 9/2013 | Suzuki et al. | |
| 2013/0242321 | A1 | 9/2013 | Okada et al. | |
| 2013/0242361 | A1 | 9/2013 | Matsumoto et al. | |
| 2013/0258368 | A1 | 10/2013 | Shigemoto et al. | |
| 2013/0258369 | A1 | 10/2013 | Suzuki et al. | |
| 2015/0070737 | A1 | 3/2015 | Hirata et al. | |
| 2015/0158309 | A1 | 6/2015 | Fujii et al. | |
| 2015/0162372 | A1 | 6/2015 | Yorimoto et al. | |

FOREIGN PATENT DOCUMENTS

| | | |
|---|---|---|
| JP | 2010-023459 | 2/2010 |
| JP | 2012-232499 | 11/2012 |
| JP | 2013-51671 | 3/2013 |
| JP | 2013-177014 | 9/2013 |
| JP | 2013-208873 | 10/2013 |

OTHER PUBLICATIONS

U.S. Appl. No. 14/565,182, filed Dec. 9, 2014.

* cited by examiner

NOZZLE TESTING DEVICE AND IMAGE FORMING APPARATUS

CROSS-REFERENCE TO RELATED APPLICATIONS

The present application claims priority to and incorporates by reference the entire contents of Japanese Patent Application No. 2014-134119 filed in Japan on Jun. 30, 2014 and Japanese Patent Application No. 2015-106752 filed in Japan on May 26, 2015.

BACKGROUND OF THE INVENTION

1. Field of the Invention

The present invention relates to a nozzle testing device and an image forming apparatus.

2. Description of the Related Art

In image forming apparatuses such as inkjet printers that make printing by discharging ink on a recording medium, clogging of a nozzle for discharging ink causes discharge failure to degrade the image quality of a printed image. It is known that a test pattern for testing is formed by discharging ink from the nozzles to a recording medium and the test pattern is used for testing for discharge failure of the nozzles. If discharge failure is detected, maintenance of the nozzles is performed.

For example, Japanese Laid-open Patent Publication No. 2010-23459 discloses a method of detecting discharge failure of nozzles, such as non-discharge of ink and ink droplet flight deflection, by forming a pattern including a solid recording area and a dots area and analyzing the captured image of the pattern. Specifically, according to the method described in Japanese Laid-open Patent Publication No. 2010-23459, when a white line is detected from the solid recording area, whether the discharge failure is caused by non-discharge of ink or ink droplet flight deflection is determined by checking the presence/absence of corresponding dots in the dots area.

Image forming apparatuses are now widespread that make printing using special ink such as colorless transparent ink called clear ink and white ink in addition to yellow, magenta, cyan, black, and other color inks. Ink such as clear ink and white ink have low visibility when discharged on a recording medium. Because of this, when the nozzles that discharge clear ink and white ink are tested for discharge failure, the method described in Japanese Laid-open Patent Publication No. 2010-23459 fails to detect a white line from the image of the solid recording area and fails to appropriately test the nozzles for discharge failure.

SUMMARY OF THE INVENTION

It is an object of the present invention to at least partially solve the problems in the conventional technology.

A nozzle testing device includes: a two-dimensional image sensor to capture an image of a pattern formed or a recording object by discharging ink from a nozzle row including a plurality of nozzles while moving the nozzle row and the recording object relative to each other in a direction orthogonal to the nozzle row; a light source unit provided such that regularly reflected light by the pattern enters the two-dimensional image sensor and forms a regular reflection area in the image of the pattern captured by the two-dimensional image sensor; and a detection unit to analyze the image to detect discharge failure of the nozzles. The regular reflection area is formed in the image such that a dimension in a direction corresponding to the direction of relative movement between the nozzle row and the recording object is greater than a dimension in a direction orthogonal to the direction corresponding to the direction of relative movement in the image.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A nozzle testing device and an image forming apparatus according to an embodiment of the present invention will be described in details below with reference to the accompanying drawings. In the embodiments illustrated below, a colorimetric camera that is mounted on an image forming apparatus configured as an inkjet printer and has the function of capturing an image of a colorimetric pattern formed by the image forming apparatus on a recording medium and calculating a colorimetric value serves to function as a nozzle testing device according to the present invention.

Mechanical Configuration of Image Forming Apparatus

Figure 1:
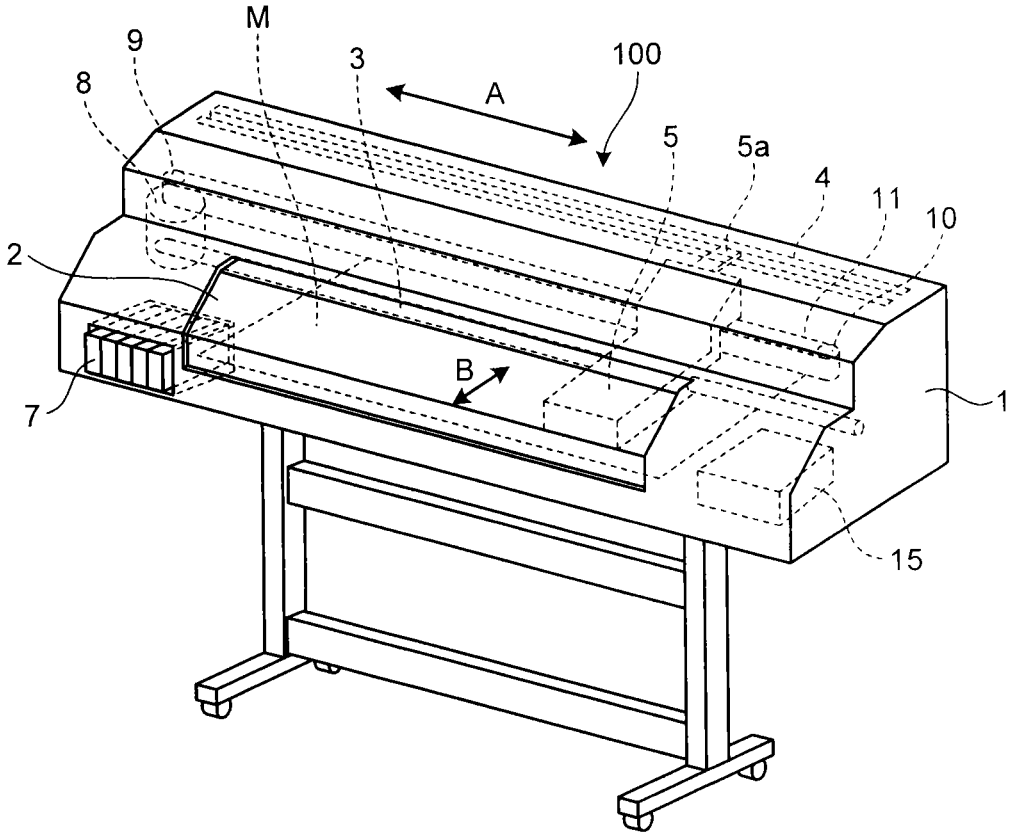
FIG. 1 is a perspective view of the inside of an image forming apparatus.
Figure 2:
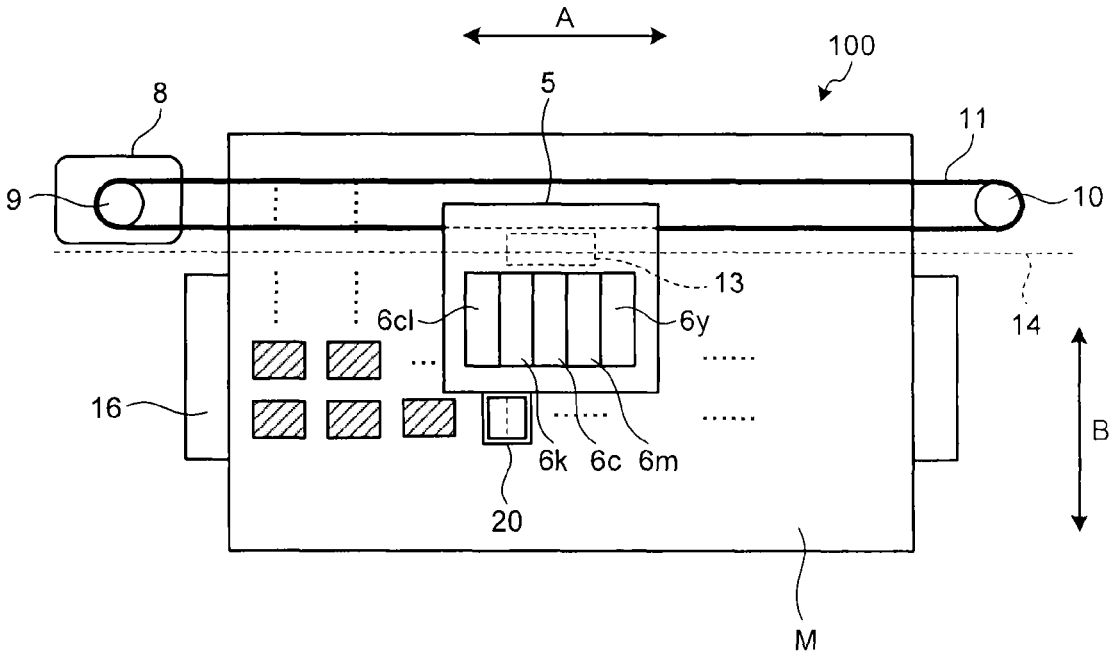
FIG. 2 is a top view of the mechanical configuration in the inside of the image forming apparatus.
Figure 3:
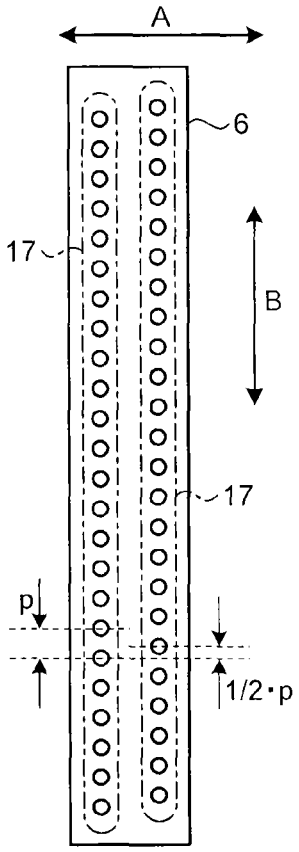
FIG. 3 is a plan view of a recording head as viewed from the ink discharging surface.

Referring to FIG. 1 to FIG. 3, the mechanical configuration of an image forming apparatus 100 in the present embodiment is firstly described. FIG. 1 is a perspective view of the inside of the image forming apparatus 100. FIG. 2 is a top view of the mechanical configuration in the inside of the image forming apparatus 100. FIG. 3 is a plan view of a recording head 6 mounted on a carriage 5 as viewed from the ink discharging surface.

As illustrated in FIG. 1, the image forming apparatus 100 in the present embodiment includes the carriage 5 that reciprocates in the main-scanning direction (the direction of the arrow A in the figure). The carriage 5 is supported by a main guide rod 3 extending in the main-scanning direction. The carriage 5 has a coupling piece 5*a*. The coupling piece 5*a* is engaged in a sub-guide member 4 provided parallel to the main guide rod 3 to stabilize the posture of the carriage 5.

As illustrated in FIG. 2, for example, five recording heads 6*y*, 6*m*, 6*c*, 6*k*, 6*cl* are mounted in the carriage 5. The recording head 6*y* is a recording head for discharging yellow ink. The recording head 6*m* is a recording head for discharging magenta ink. The recording head 6*c* is a recording head for discharging cyan ink. The recording head 6*k* is a recording head for discharging black ink. The recording head 6*cl* is a recording head for discharging clear ink. These recording heads 6*y*, 6*m*, 6*c*, 6*k*, 6*cl* are hereinafter collectively referred to as the recording heads 6. The recording heads 6 are supported on the carriage 5 with the ink discharging surfaces facing down (toward a recording medium M).

Cartridges 7, which are ink supplies for supplying ink to the recording heads 6, are not mounted on the carriage 5 but disposed at a predetermined position in the image forming apparatus 100. The cartridges 7 are coupled to the recording heads 6 through not-illustrated pipes, and ink is supplied from the cartridges 7 to the recording heads 6 through the pipes.

The carriage 5 is coupled to a timing belt 11 stretched between a driving pulley 9 and a driven pulley 10. The driving pulley 9 is rotated by driving a main scanning motor 8. The driven pulley 10 has a mechanism for adjusting the distance to the driving pulley 9 and serves to give a predetermined tension to the timing belt 13. The timing belt 11 is fed by driving the main scanning motor 8 to cause the carriage 5 to reciprocate in the main-scanning direction. The movement of the carriage 5 in the main-scanning direction is controlled, for example, as illustrated in FIG. 2, based on an encoder value obtained by an encoder sensor 13 provided at the carriage 5 for sensing a mark on an encoder sheet 14.

The image forming apparatus 100 in the present embodiment further includes a maintenance mechanism 15 for maintaining the reliability of the recording heads 6. The maintenance mechanism 15 performs, for example, cleaning and capping of the discharging surfaces of the recording heads 6 and ejection of unnecessary ink from the recording heads 6. In the present embodiment, when a discharge failure is detected in the nozzle of the recording head 6, the maintenance mechanism 15 performs recovery operations such as wiping of the discharging surface and idle discharge of ink to eliminate the discharge failure.

As illustrated in FIG. 2, a platen 16 is provided at a position facing the discharging surfaces of the recording heads 6. The platen 16 supports the recording medium M when ink is discharged from the recording heads 6 onto the recording medium M. The image forming apparatus 100 in the present embodiment is a wide apparatus in which the moving distance of the carriage 5 in the main-scanning direction is long. The platen 16 is therefore formed with a plurality of plate-shaped members connected in the main-scanning direction (the moving direction of the carriage 5). The recording medium M is sandwiched between conveyance rollers driven by a not-illustrated sub-scanning motor and is intermittently conveyed on the platen 16 in the sub-scanning direction (the direction orthogonal to the main-scanning direction) denoted by the arrow B in the figure.

As illustrated in FIG. 3, the recording heads 6 each have a nozzle row 17 including a plurality of nozzles arranged in the sub-scanning direction (the direction of the arrow B in the figure). The recording head 6 discharges ink from the nozzle row 17 to form an image on the recording medium M while moving in the main-scanning direction relative to the recording medium M on the platen 16 with the carriage 5 reciprocating in the main-scanning direction (the direction of the arrow A in the figure). In the recording head 6 illustrated in FIG. 3, two nozzle rows 17 are provided. One of the nozzle rows 17 is formed such that each nozzle is shifted by approximately ½·p in the sub-scanning direction with respect to another nozzle row 17. Hence, an image with a high resolution in the sub-scanning direction can be formed.

The components described above in the image forming apparatus 100 in the present embodiment are disposed in the inside of a casing 1. The casing 1 has a cover member 2 that can be opened and closed. During maintenance of the image forming apparatus 100 or when a paper jam occurs, the cover member 2 is opened to enable work on the components in the inside of the casing 1.

During color adjustment for adjusting colors, the image forming apparatus 100 in the present embodiment discharges ink onto the recording medium M on the platen 16 from the nozzle rows 17 of the recording heads 6 to form a number of colorimetric patterns and measures the colors of the colorimetric patterns. The colorimetric patterns are formed on the recording medium M by the image forming apparatus 100 actually using ink and reflect characteristics unique to the image forming apparatus 100. The colorimetric values of a number of colorimetric patterns can be used to generate or modify a device profile that describes the characteristics unique to the image forming apparatus 100. Color conversion between the standard color space and the device-dependent colors is performed based on the device profile, whereby the image forming apparatus 100 can output an image with high reproducibility.

The image forming apparatus 100 in the present embodiment includes a colorimetric camera 20 having a function of capturing an image of a colorimetric pattern formed on a recording medium M and calculating a colorimetric value. The colorimetric camera 20 is supported on the carriage 5 with the recording heads 6, as illustrated in FIG. 2. With the recording medium M conveyed and the carriage 5 moved, the colorimetric camera 20 moves on the recording medium M having a colorimetric pattern formed thereon and captures an image when reaching the position facing the colorimetric pattern. The colorimetric value of the colorimetric pattern is calculated based on the RGB value of the colorimetric pattern obtained through the image capturing.

In the image forming apparatus 100 in the present embodiment, the colorimetric camera 20 is used to test whether discharge failure occurs in the nozzles of the recording heads 6. As for the recording heads 6 that discharge color inks such as the recording heads 6*y*, 6*m*, 6*c*, 6*k*, for example, the colorimetric camera 20 captures an image of a colorimetric pattern of a single color ink formed on a recording medium M (an example of the recording object) using these recording heads 6*y*, 6*m*, 6*c*, 6*k* singly, and the captured image is used for testing for discharge failure of the nozzles. That is, the nozzles in the recording head 6 that discharges color ink can be tested for discharge failure by detecting a white line produced in the colorimetric pattern of a single color ink, in the same manner as in the conventional technique.

As for the recording head 6*cl* that discharges clear ink, however, a white line does not appear in the image captured under the same lighting conditions as in the color measurement of the colorimetric pattern, and therefore the nozzles cannot be tested for discharge failure. In order to test for discharge failure of the nozzles in the recording head 6*cl*, a test pattern (hereinafter called a testing pattern to distinguish it from the colorimetric pattern) formed on a recording medium M (an example of the recording object) using the recording head 6*cl* alone is irradiated with light from a light source unit 31 described later to capture an image. The light source unit 31 is provided such that regularly reflected light by the testing pattern enters a two-dimensional image sensor described later and forms a regular reflection area in the image of the testing pattern captured by the two-dimensional image sensor. The colorimetric camera 20 analyzes the image of the testing pattern including this regular reflection area and detects discharge failure of the nozzles in the recording head 6*cl* that discharges clear ink.

Specific Example of Colorimetric Camera

Figure 4A:
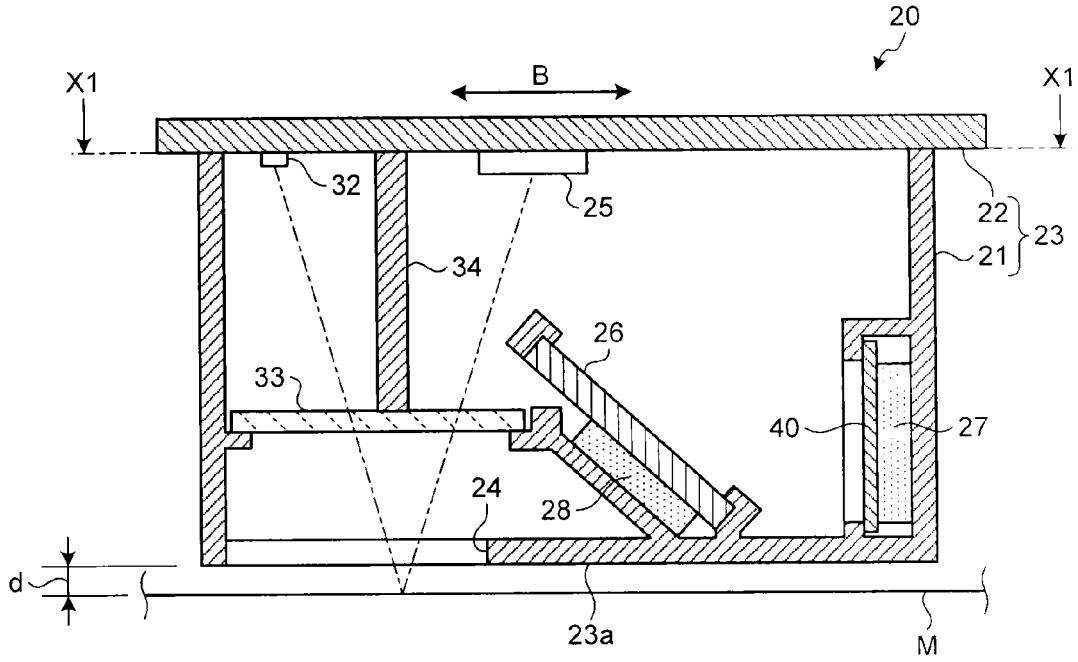
FIG. 4A is a longitudinal cross-sectional view of a colorimetric camera.
Figure 4B:
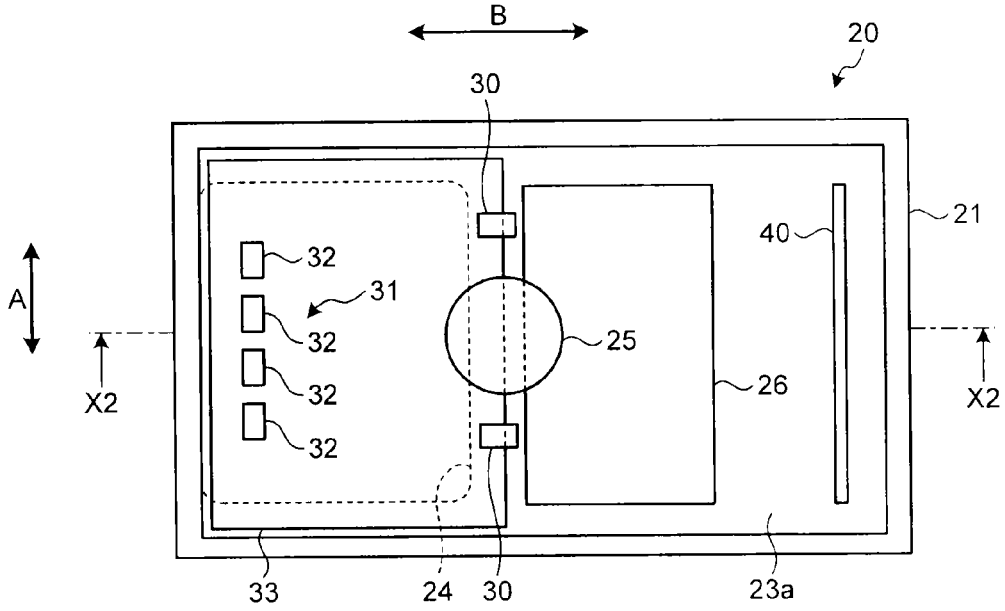
FIG. 4B is a plan view of the inside of the colorimetric camera as viewed from the direction X1 in FIG. 4A.

Referring now to FIG. 4A and FIG. 4B, a specific example of the colorimetric camera 20 will be described in details. FIG. 4A and FIG. 4B illustrate an exemplary mechanical configuration of the colorimetric camera 20. FIG. 4A is a longitudinal cross-sectional view (the cross section taken along the line X2-X2 in FIG. 4B) of the colorimetric camera 20, and FIG. 4B is a plan view of the inside of the colorimetric camera 20 as viewed from the direction X1 in FIG. 4A. It is noted that FIG. 4B does not illustrate, for example, a structure for supporting the members arranged in the inside of the colorimetric camera 20 for the sake of easy understanding of the positional relation between those members.

The colorimetric camera 20 has a housing 23 constructed by combing a frame 21 and a substrate 22. The frame 21 is formed like a tube with a base and with one end open at the top face of the housing 23. The substrate 22 is fastened to the frame 21 so as to close the open end of the frame 21 and form the top face of the housing 23 and is integrated with the frame 21.

The housing 23 is fixed to the carriage 5 such that its bottom face 23*a* faces the recording medium M on the platen 16 with a predetermined gap d. The bottom face 23*a* of the housing 23 facing the recording medium M has an opening 24 for enabling an image of a pattern (the colorimetric pattern or the testing pattern) formed on the recording medium M to be captured from the inside of the housing 23.

In the inside of the housing 23, a two-dimensional image sensor 25 is provided for capturing an image. The two-dimensional image sensor 25 mainly includes an image capturing device such as a CCD sensor or a CMOS sensor and an imaging forming lens and is mounted, for example, on the inner surface (the part-mounted surface) of the substrate 22 such that the light receiving surface faces the bottom face 23*a* of the housing 23.

In the inside of the housing 23, a reference chart 10 and a reflecting mirror 26 are provided. An image of the reference chart 40 is captured together with the image of the colorimetric pattern by the two-dimensional image sensor 25 when the color of the colorimetric pattern is measured. The reflecting mirror 26 introduces the optical image of the reference chart 40 to the two-dimensional image sensor 25. The reference chart 40 is disposed, for example, on a side surface of the frame 21 with a buffer member 27 interposed. The reflecting mirror 26 is supported, for example, on a structure with a buffer member 28 interposed so as to be inclined at a predetermined angle relative to the bottom face 23*a* of the housing 23. The details of the reference chart 40 will be described later.

In the inside of the housing 23, a colorimetric light source 30 is provided for illuminating the image capturing area of the two-dimensional image sensor 25 generally uniformly with diffusing light when the color of the colorimetric pattern is measured (see FIG. 4B). For example, a light emitting diode (LED) is used as the colorimetric light source 30. The colorimetric light source 30 is mounted, for example, on the inner surface of the substrate 22. It is noted that the colorimetric light source 30 may not be directly mounted on the substrate 22 as long as it is located to be able to illuminate the image capturing area of the two-dimensional image sensor 25 generally uniformly. Although an LED is used as the colorimetric light source 30 in the present embodiment, the kind of the light source is not limited to an LED). For example, organic electroluminescence (EL) may be used as the colorimetric light source 30. When organic EL is used as the colorimetric light source 30, improvement in color-measuring accuracy can be expected because illumination light close to the spectral distribution of solar light can be obtained.

In the inside of the housing 23, the light source unit 31 is also provided for emitting light to the testing pattern formed on the recording medium M when the nozzles are tested for discharge failure in the recording head 6*cl* that discharges clear ink. The light source unit 31 is provided such that light emitted from the light source unit 31 and regularly reflected by the testing pattern enters the two-dimensional image sensor 25 and forms a regular reflection area in the image of the testing pattern captured by the two-dimensional image sensor 25. The regular reflection area is an area (for example, the area denoted by R in FIG. 8) in the image formed by the two-dimensional image sensor 25 receiving the regularly reflected light.

In the colorimetric camera 20 in the present embodiment, in the image of the testing pattern captured by the two-dimensional image sensor 25, the regular reflection area is formed to be longer in the direction corresponding to the main-scanning direction (the direction of the arrow A in the figure) that is the direction of relative movement between the recording head 6*cl* and the recording medium M in forming a testing pattern. That is, the light source unit 31 is configured so as to form a regular reflection area shaped such that the length in the direction corresponding to the main-scanning direction is greater than the length in the direction corresponding to the sub-scanning direction in the image of the testing pattern. Hereinafter, the direction corresponding to the main-scanning direction in the image of the testing pattern is simply referred to as the main-scanning direction, and the direction corresponding to the sub-scanning direction in the image of the testing pattern is simply referred to as the sub-scanning direction, for convenience of explanation.

For example, as illustrated in FIG. 4B, the light source unit 31 includes a plurality of testing light sources 32 disposed in the inside of the housing 23 so as to be lined on a straight line in the main-scanning direction (the direction of the arrow A in the figure). For example, LEDs are used as the testing light sources 32. Since the colorimetric camera 20 is fixed to the carriage 5 with the recording heads 6 mounted thereon, the direction in which the testing light sources 32 are lined agrees with the direction of relative movement between the recording head 6*cl* and the recording medium M in forming a testing pattern. Therefore, the image of the testing pattern captured by the two-dimensional image sensor 25 has a regular reflection area in which the regularly reflected light rays from the testing light sources 32 are lined in the main-scanning direction.

The light source unit 31 may have any configuration that can form a regular reflection area longer in the main-scanning direction than in the sub-scanning direction in the image of the testing pattern captured by the two-dimensional image sensor 25. For example, the light source unit 31 may be configured with a single testing light source that forms a strip-like regular reflection area elongated in the main-scanning direction.

In the inside of the housing 23, a cover member 33 is provided for preventing ink mist, dust, and other substances intruding into the housing 23 through the opening 24 from adhering to the two-dimensional image sensor 25, the colorimetric light source 30, the testing light sources 32 of the light source unit 31, the reference chart 40, and other components. The cover member 33 is a transparent optical member having a sufficient transmittance for light from the colorimetric light source 30 and the testing light sources 32 of the light source unit 31 and is disposed in the inside of the housing 23 parallel to the opening 24.

The cover member 33 is disposed in the optical path of light emitted from the testing light sources 32 of the light source unit 31 onto the testing pattern. Therefore, light from the testing light sources 32 is regularly reflected not only by the testing pattern but also by the cover member 33. If the regularly reflected light by the cover member 33 enters the two-dimensional image sensor 25, the test for nozzle discharge failure in the recording head 6*cl* may be adversely affected. A light-shielding member 34 is therefore provided in the inside of the housing 23 to block regularly reflected light by the cover member 33 and prevent light from entering the two-dimensional image sensor 25. For example, as illustrated in FIG. 4A, the light-shielding member 34 is formed as a partitioning wall vertical to the cover member 33.

The light-shielding member 34 may not be provided if the testing light sources 32 of the light source unit 31 can be disposed at a position where the regularly reflected light by the testing pattern enters the two-dimensional image sensor 25 and the regularly reflected light by the cover member 33 does not enter the two-dimensional image sensor 25.

The colorimetric camera 20 in the present embodiment captures an image of a colorimetric pattern with the two-dimensional image sensor 25, with the colorimetric light source 30 turned on, during color measurement of the colorimetric pattern or during nozzle testing in the recording heads 6*y*, 6*m*, 6*c*, 6*k* that discharge color ink. On the other hand, during the nozzle test in the recording head 6*cl* that discharges clear ink, an image of a testing pattern is captured with two-dimensional image sensor 25, with the testing light sources 32 of the light source unit 31 turned on. The image of the testing pattern with the regular reflection area formed is then analyzed to detect discharge failure of the nozzles in the recording head 6*cl*.

Specific Example of Reference Chart

Figure 5:
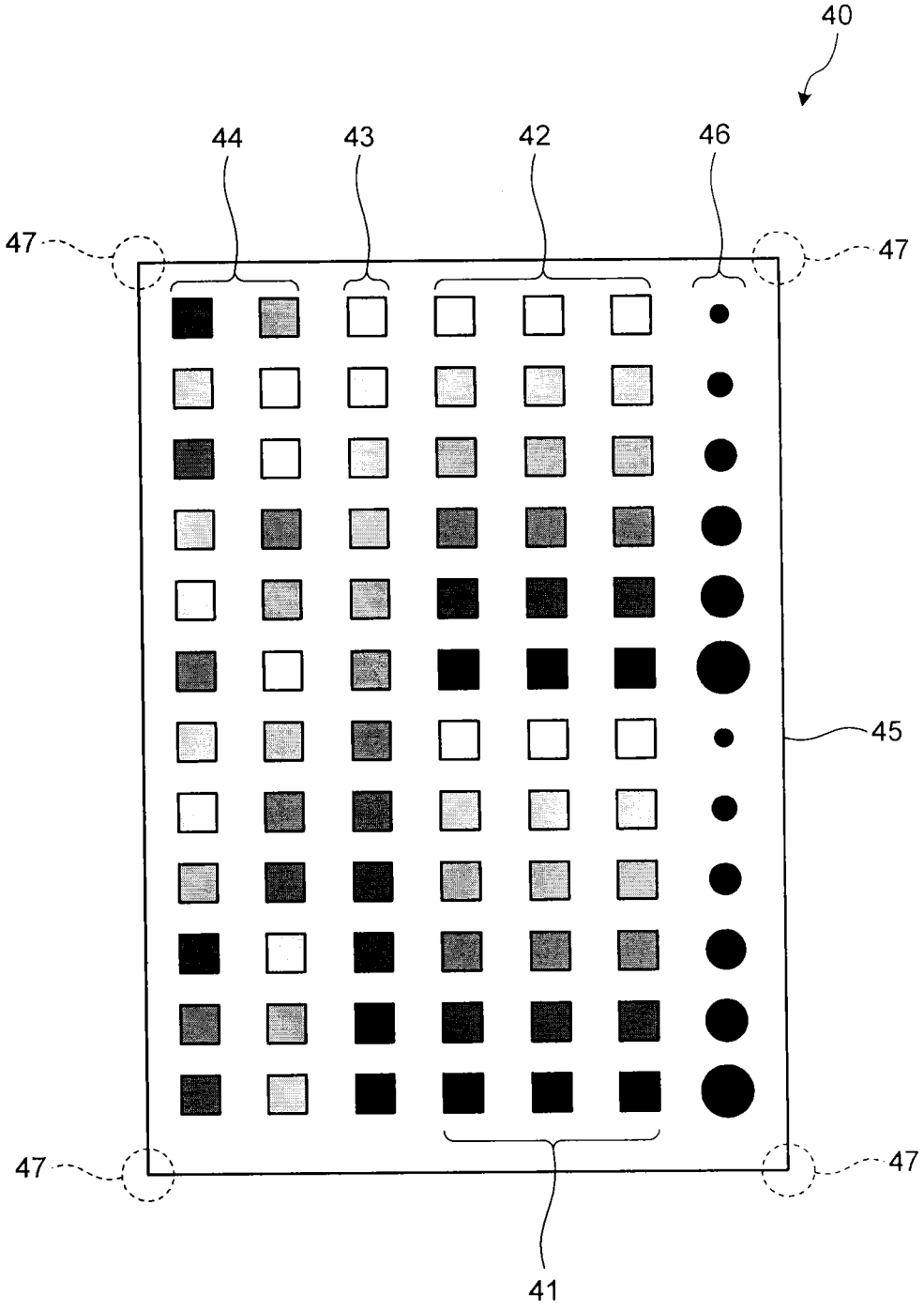
FIG. 5 illustrates a specific example of a reference chart.

Referring now to FIG. 5, the reference chart 40 disposed in the inside of the housing 23 of the colorimetric camera 20 will be described in details. FIG. 5 illustrates a specific example of the reference chart 40.

The reference chart 40 illustrated in FIG. 5 has a plurality of reference patch rows 41 to 44 in which reference patches for color measurement are arranged, a dot diameter-measuring pattern row 46, a distance-measuring line 45, and chart position-specifying markers 47.

The reference patch rows 41 to 44 include the reference patch row 41 in which the reference patches of YMCK primary colors are arranged in order of gradation, the reference patch row 42 in which the reference patches of RGB secondary colors are arranged in order of gradation, the reference patch row 43 in which reference patches of grayscale are arranged in order of gradation, and the reference patch row 44 in which the reference patches of tertiary colors are arranged. The dot diameter-measuring pattern row 46 is a pattern row for geometric shape measurement in which circle patterns different in size are arranged in order of size. The dot diameter-measuring pattern row 46 can be used to measure the diameter of a dot in the image formed on the recording medium M.

The distance-measuring line 45 is formed as a rectangular frame that surrounds the reference patch rows 41 to 44 and the dot diameter-measuring pattern row 46. The chart position-specifying markers 47 are provided at four corners of the distance-measuring line 45 to function as markers for specifying the position of each reference patch. The position of the reference chart 40 and the position of each reference patch or pattern can be specified by specifying the distance-measuring line 45 and the chart position-specifying markers 47 at the four corners from the image of the reference chart 40 captured by the two-dimensional image sensor 25.

Each reference patch in the reference patch rows 41 to 44 for color measurement is used as a reference of color tone that reflects the image capturing conditions of the colorimetric camera 20. The configuration of the reference patch rows 41 to 44 for color measurement arranged in the reference chart 40 is not limited to the example illustrated in FIG. 5, and any reference patch row can be employed. For example, a reference patch that can specify a color range as wide as possible may be used. The reference patch row 41 of YMCK primary colors and the reference patch row 43 of grayscale may be formed with patches having colorimetric values of the ink used in the image forming apparatus 100. The reference patch row 42 of RGB secondary colors may be formed with patches having colorimetric values that can be produced with the ink used in the image forming apparatus 100. Reference color chips with established colorimetric values of, for example, Japan Color may be used.

The reference chart 40 used in the present embodiment has the reference patch rows 41 to 44 in the shape of general patches (color chips). However, the reference chart 40 may not be formed to have such reference patch rows 41 to 44. The reference chart 40 is not limited to any specific configuration as long as a plurality of colors usable for color measurement are arranged such that the respective positions can be specified.

In the colorimetric camera 20 in the present embodiment, when the color of the colorimetric pattern is measured, the two-dimensional image sensor 25 simultaneously captures an image of the colorimetric pattern formed on the recording medium M and the reference chart 40 inside the housing 23 under illumination with the colorimetric light source 30. The obtained image is then used to calculate the colorimetric value of the colorimetric pattern. In doing so, the position and the angle of the reflecting mirror 26 are adjusted such that the captured image is focused on both the colorimetric pattern outside the housing 23 and the reference chart 40 inside the housing 23. The wording "simultaneously capturing an image" means acquiring image data of one frame including the colorimetric pattern and the reference chart 40. That is, an image of the colorimetric pattern and the reference chart 40 is simultaneously captured even when there is a time lag in data acquisition for each pixel, as long as image data including the colorimetric pattern and the reference chart 40 in one frame is acquired.

The mechanical configuration of the colorimetric camera 20 described above is illustrated only by way of example, and the embodiments are not limited thereto. The colorimetric camera 20 in the present embodiment is susceptible to various modifications and changes to the configuration above as long as it can at least perform color measurement of the colorimetric pattern using the two-dimensional image sensor 25 and a test for nozzle discharge failure in the recording head 6*cl* using the testing pattern.

In the present embodiment, the colorimetric camera 20 having the function of measuring the color of the colorimetric pattern serves to function as a nozzle testing device. However, the nozzle testing device may be implemented using an image capturing device different from the colorimetric camera 20. In this case, the image capturing device different from the colorimetric camera 20 includes a two-dimensional image sensor similar to the two-dimensional image sensor 25 and a light source unit corresponding to the light source unit 31. The regular reflection area is then formed in the image of the testing pattern captured by the two-dimensional image sensor, and the image is analyzed to detect discharge failure of the nozzles in the recording head 6*cl*.

Overall Configuration of Control Mechanism of Image Forming Apparatus

Figure 6:
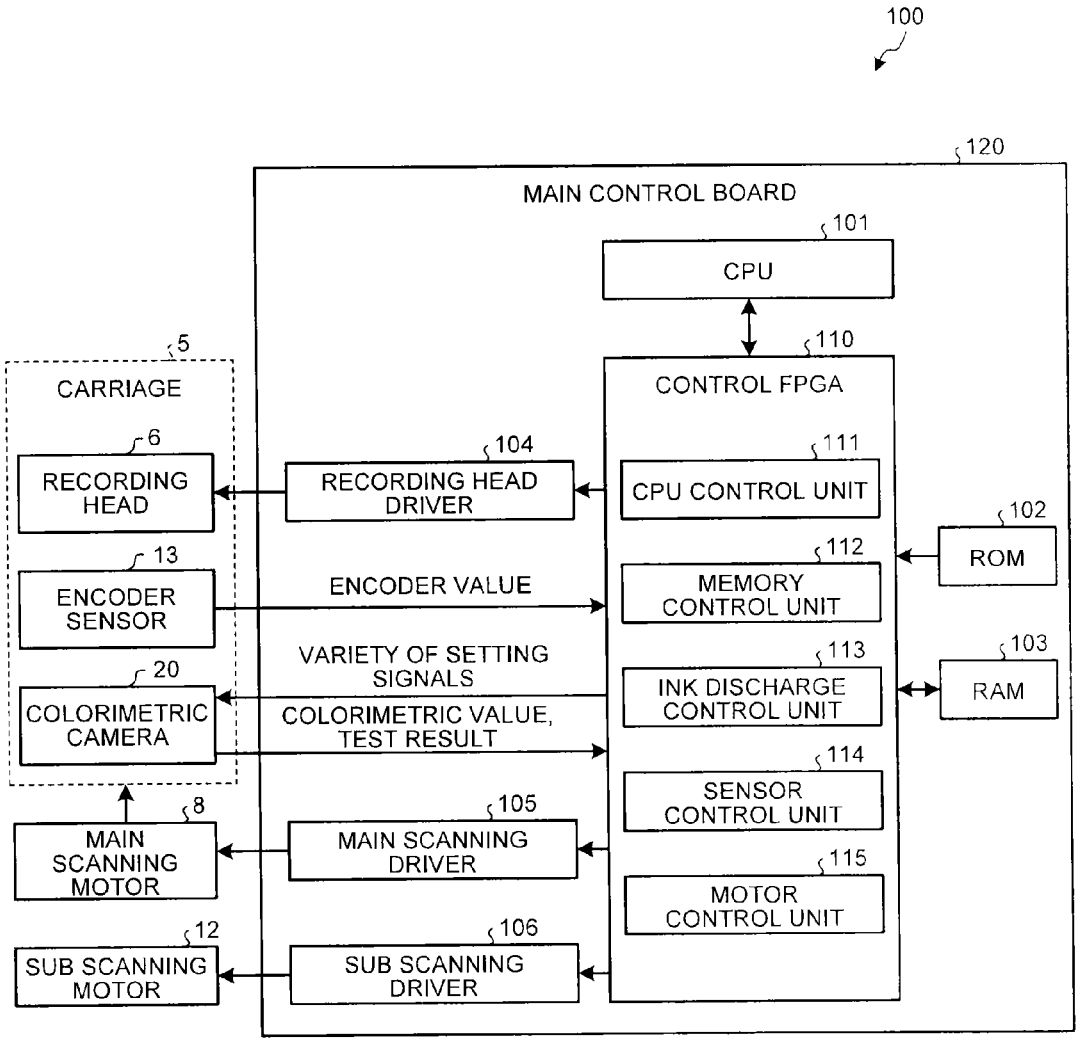
FIG. 6 is a block diagram illustrating the overall configuration of the control mechanism of the image forming apparatus.

Referring now to FIG. 6, the overall configuration of the control mechanism of the image forming apparatus 100 in the present embodiment will be described. FIG. 6 is a block diagram illustrating the overall configuration of the control mechanism of the image forming apparatus 100.

As illustrated in FIG. 6, the image forming apparatus 100 in the present embodiment includes a central processing unit (CPU) 101, a read only memory (ROM) 102, a random access memory (RAM) 103, a recording head driver 104, a main scanning driver 105, a sub scanning driver 106, a control field-programmable gate array (FPGA) 110, the recording heads 6, the colorimetric camera 20, the encoder sensor 13, the main scanning motor 8, and a sub scanning motor 12. The CPU 101, the ROM 102, the RAM 103, the recording head driver 104, the main scanning driver 105, the sub scanning driver 106, and the control FPGA 110 are mounted on a main control board 120. The recording heads 6, the encoder sensor 13, and the colorimetric camera 20 are mounted on the carriage 5 as described above.

The CPU 101 controls the whole of the image forming apparatus 100. For example, the CPU 101 executes a variety of control programs stored in the ROM 102 using the RAM 103 as a working area and outputs a control command for controlling a variety of operations in the image forming apparatus 100.

The recording head driver 104, the main scanning driver 105, and the sub scanning driver 106 are drivers for driving the recording heads 6, the main scanning motor 8, and the sub scanning motor 12, respectively.

The control FPGA 110 cooperates with the CPU 101 to control a variety of operations in the image forming apparatus 100. The control FPGA 110 includes, as functional components, for example, a CPU control unit 111, a memory control unit 112, an ink discharge control unit 113, a sensor control unit 114, and a motor control unit 115.

The CPU control unit 111 communicates with the CPU 0 to send various types of information acquired by the control FPGA 110 to the CPU 101 and inputs a control command output from the CPU 101.

The memory control unit 112 performs memory control for the CPU 101 to access the ROM 102 and the RAM 103.

The ink discharge control unit 113 controls the operation of the recording head driver 104 in response to a control command from the CPU 101 and thereby controls the timing of discharging ink from the recording heads 6 driven by the recording head driver 104.

The sensor control unit 114 performs processing on a sensor signal such as an encoder value output from the encoder sensor 13.

The motor control unit 115 controls the operation of the main scanning driver 105 in response to a control command from the CPU 101 and thereby controls the main scanning motor 8 driven by the main scanning driver 105 to control the movement of the carriage 5 in the main-scanning direction. The motor control unit 115 also controls the operation of the sub scanning driver 106 in response to a control command from the CPU 101 and thereby controls the sub scanning motor 12 driven by the sub scanning driver 106 to control the movement of the recording medium M on the platen 16 in the sub-scanning direction.

The units described above are exemplary control functions implemented by the control FPGA 110, and other various control functions may be additionally implemented by the control FPGA 110. All or some of the control functions above may be implemented by a program executed by the CPU 101 or another general-purpose CPU. Some of the control functions above may be implemented by dedicated hardware such as an FPGA different from the control FPGA 110 or an application specific integrated circuit (ASIC).

The recording heads 6 are driven by the recording head driver 104 controlled by the CPU 101 and the control FPGA 110 to discharge ink onto the recording medium M on the platen 16 to form an image.

As described above, the colorimetric camera 20 captures an image of the colorimetric pattern formed on the recording medium M together with the reference chart 40 during color adjustment for the image forming apparatus 100 and calculates the colorimetric value (the color specification value in the standard color space, for example, the L*a*b* value in the L*a*b* color space) of the colorimetric pattern, based on the RGB value of the colorimetric pattern and the RGB value of each reference patch in the reference chart 40 obtained from the captured image. The colorimetric value of the colorimetric pattern calculated by the colorimetric camera 20 is sent to the CPU 101 through the control FPGA 110. Specific examples of a method of calculating the colorimetric value of the colorimetric pattern include the method disclosed in Japanese Laid-open Patent Publication No. 2013-051671.

The colorimetric camera 20 has a function of testing for discharge failure of the nozzles in the recording heads 6 as described above. In particular when the recording head 6*cl* that discharges clear ink is tested, the colorimetric camera 20 captures an image of a testing pattern with the two-dimensional image sensor 25 under illumination by the light source unit 31 and analyzes the image of the testing pattern having a regular reflection area to detect discharge failure of the nozzles, as described above. The test result of discharge failure of the nozzles in the recording heads 6 is sent from the colorimetric camera 20 to the CPU 101 through the control FPGA 110.

The encoder sensor 13 outputs an encoder value obtained by sensing the mark on the encoder sheet 14 to the control FPGA 110. This encoder value is sent from the control FPGA 110 to the CPU 101 to be used, for example, for calculating the position and the speed of the carriage 5. The CPU 101 generates and outputs a control command for controlling the main scanning motor 8, based on the position and the speed of the carriage 5 calculated from the encoder value.

Configuration of Control Mechanism of Colorimetric Camera

Figure 7:
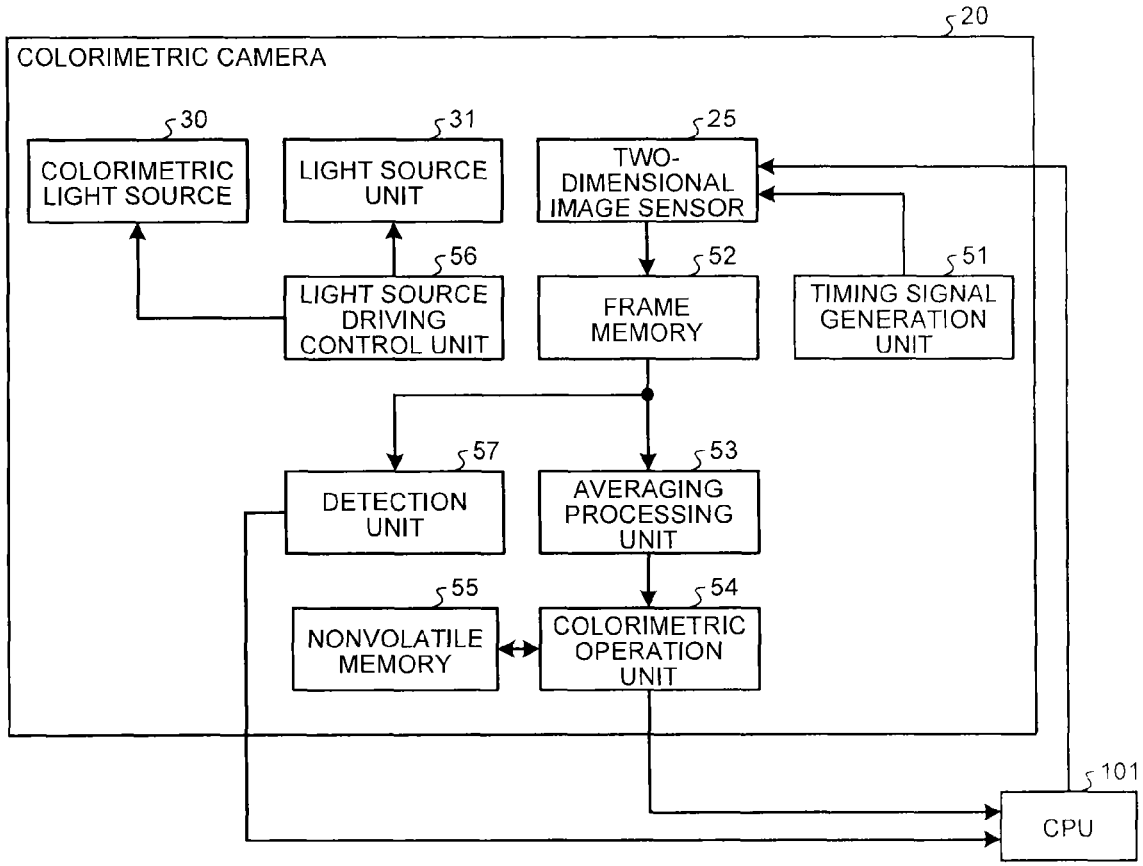
FIG. 7 is a block diagram illustrating an exemplary configuration of the control mechanism of the colorimetric camera.

Referring now to FIG. 7, the control mechanism of the colorimetric camera 20 will be specifically described. FIG. 7 is a block diagram illustrating an exemplary configuration of the control mechanism of the colorimetric camera 20.

As illustrated in FIG. 7, the colorimetric camera 20 includes a timing signal generation unit 51, a frame memory 52, an averaging processing unit 53, a colorimetric operation unit 54, a nonvolatile memory 55, a light source driving control unit 56, and a detection unit 57 in addition to the two-dimensional image sensor 25, the colorimetric light source 30, and the light source unit 31 described above.

The two-dimensional image sensor 25 converts light incident on the two-dimensional image sensor 25 into an electrical signal and outputs image data obtained by capturing the image of the image capturing area. The two-dimensional image sensor 25 contains the function of converting the analog signal obtained through photoelectric conversion into digital image data, performing a variety of image processing such as shading correction, white balance correction, γ correction, and image data format conversion on the image data, and outputting the processed data. The operating conditions of the two-dimensional image sensor 25 are set in accordance with a variety of setting signals from the CPU 101. Some or all of a variety of image processing on image data may be performed outside the two-dimensional image sensor 25.

The timing signal generation unit 51 generates a timing signal for controlling the timing of starting image capturing by the two-dimensional image sensor 25 and supplies the generated timing signal to the two-dimensional image sensor 25. In the present embodiment, the two-dimensional image sensor 25 captures an image not only when the color of the colorimetric pattern is measured but also when the nozzles in the recording heads 6 are tested for discharge failure. The timing signal generation unit 51 generates a timing signal for controlling the timing of starting image capturing by the two-dimensional image sensor 25 and supplies the generated timing signal to the two-dimensional image sensor 25 during color measurement of the colorimetric pattern and during testing of the nozzles in the recording heads 6.

The frame memory 52 temporarily stores therein the image output from the two-dimensional image sensor 25.

When the color of the colorimetric pattern is measured, the averaging processing unit 53 extracts a color measurement target area set near the center of the area where the image of the colorimetric pattern is captured and the area where the image of each reference patch of the reference chart 40 is captured, from the image output from the two-dimensional image sensor 25 and temporarily stored in the frame memory 52. The averaging processing unit 53 then averages the image data of the extracted color measurement target area to output the obtained value as the RGB value of the colorimetric pattern to the colorimetric operation unit 54 and also averages the image data of the extracted area where the image of each reference patch is captured, to output the obtained value as the RGB of each reference patch to the colorimetric operation unit 54.

The colorimetric operation unit 54 calculates the colorimetric value of the colorimetric pattern, based on the RGB value of the colorimetric pattern and the RGB value of each reference patch of the reference chart 40 obtained through the processing by the averaging processing unit 53. The colorimetric value of the colorimetric pattern calculated by the colorimetric operation unit 54 is sent to the CPU 101 on the main control board 120. The colorimetric operation unit 54 can calculate the colorimetric value of the colorimetric pattern, for example, by the method disclosed in Japanese Laid-open Patent. Publication No. 2013-051671, and the detailed description of the processing in the colorimetric operation unit 54 is omitted here.

The nonvolatile memory 55 stores therein a variety of data necessary for the colorimetric operation unit 54 to calculate the colorimetric value of the colorimetric pattern.

The light source driving control unit 56 generates a light source drive signal for driving the colorimetric light source 30 and the light source unit 31 (testing light sources 32) and supplies the generated signal to the colorimetric light source 30 and the light source unit 31. In the colorimetric camera 20 in the present embodiment, the colorimetric light source 30 is driven during color measurement of the colorimetric pattern and during nozzle testing in the recording heads 6*y*, 6*m*, 6*c*, 6*k* that discharge color ink, whereas the light source unit 31 is driven during nozzle testing in the recording head 6*cl* that discharges clear ink, as described above. The light source driving control unit 56 supplies a light source drive signal to the colorimetric light source 30 at a timing when the colorimetric light source 30 is driven, and supplies a light source drive signal to the light source unit 31 (testing light sources 32) at a timing when the Light source unit 31 is driven.

When the recording head 6*cl* is tested for discharge failure of the nozzles, the detection unit 57 analyzes the image of the testing pattern output from the two-dimensional image sensor 25 and temporarily stored in the frame memory 52 to detect discharge failure of the nozzles.

Figure 8:
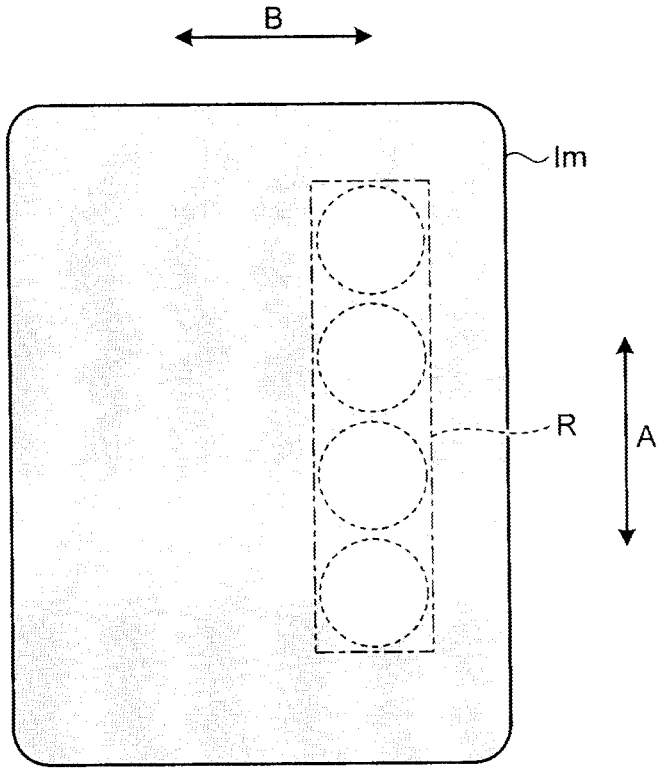
FIG. 8 schematically illustrates an image of a testing pattern captured by a two-dimensional image sensor.

FIG. 8 schematically illustrates an image Im of the testing pattern captured by the two-dimensional image sensor 25. The colorimetric camera 20 in the present embodiment captures an image of the testing pattern with the two-dimensional image sensor 25 by driving the light source unit 31 during nozzle testing in the recording head 6*cl*, so that a regular reflection area R is formed in the captured image Im of the testing pattern, as illustrated in FIG. 8. As described above, the regular reflection area R is formed, in the image Im, as an area that is elongated in the direction (in the present embodiment, the main-scanning direction illustrated by the arrow A in the figure) corresponding to the direction of relative movement between the recording head 6*cl* and the recording medium M in forming a testing pattern on the recording medium M. Therefore, if the recording head 6*cl* has a nozzle with discharge failure, a defective line with low brightness along the main-scanning direction appears in the regular reflection area R in the image Im. The detection unit 57 analyzes the image Im of the testing pattern to detect discharge failure of the nozzles.

For example, first of all, the detection unit 57 extracts the regular reflection area R from the image Im of the testing pattern temporarily stored in the frame memory 52. The detection unit 57 then obtains arithmetic means of the pixel values of pixels included in the extracted regular reflection area R in the main-scanning direction and approximates the pixel mean value for each sub scanning position by a curve. The detection unit 57 then compares the difference (residual) between the pixel mean value for each sub scanning position and the approximate curve with a predetermined threshold. If a position with a residual exceeding the threshold is found, the detection unit 57 determines that discharge failure occurs at the nozzle at the found position.

Figure 9A:
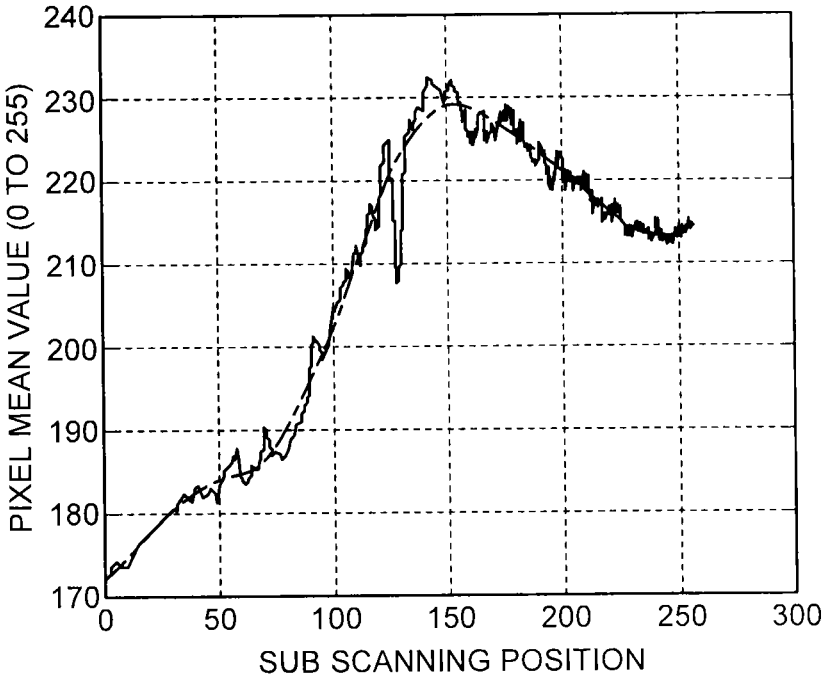
FIG. 9A and FIG. 9B illustrate the processing in a detection unit.
Figure 9B:
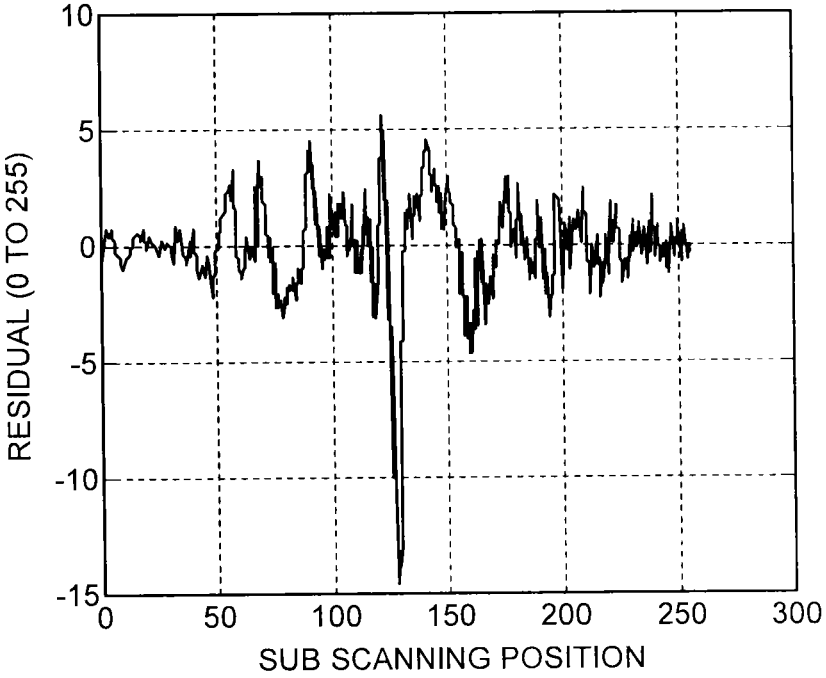

FIG. 9A and FIG. 9B illustrate the processing in the detection unit 57. FIG. 9A illustrates an example in which arithmetic means of the pixel values of pixels included in the regular reflection area R are obtained in the main-scanning direction, and the pixel mean value for each sub scanning position (solid line) is approximated by an approximate curve (dashed and single-dotted line), in which the vertical axis represents the pixel mean values in the main-scanning direction and the horizontal axis represents the sub scanning positions. FIG. 9B illustrates the difference (residual) between the pixel mean value and the approximate curve for each sub scanning position illustrated in FIG. 9A, in which the vertical axis represents the values of residual, and the horizontal axis represents the sub scanning positions. If the recording head 6*cl* has a nozzle with discharge failure, as illustrated in FIG. 9B, the value of residual (absolute value) is extremely large in one of the sub scanning positions. The detection unit 57 defines an appropriate threshold that can distinguish such a residual variation resulting from discharge failure of the nozzle and compares the residual for each sub scanning position with the threshold, whereby the discharge failure of the nozzles in the recording head 6*cl* can be detected.

The nozzles in the recording heads 6*y*, 6*m*, 6*c*, 6*k* that discharge color ink can be tested for discharge failure by checking the presence/absence of a white line in the same manner as in the conventional technique, using an image of a colorimetric pattern of a single color ink captured by the two-dimensional image sensor 25 when the color of the colorimetric pattern is measured, as described above.

The test result of discharge failure of the nozzles in the recording heads 6 is sent from the colorimetric camera 20 to the CPU 101 through the control FPGA 110 as described above. In the image forming apparatus 100 in the present embodiment, when the CPU 101 receives the test result indicating that discharge failure of a nozzle occurs in the recording heads 6, the maintenance mechanism 15 performs recovery operations such as wiping of the discharging surfaces of the recording heads 6 and idle discharge of ink in accordance with a command from the CPU 101 to eliminate the discharge failure of the nozzle. The recovery operations by the maintenance mechanism 15 may be performed on the discharging surfaces of the recording heads 6 as a whole or may be performed on a defective area that is an area including the nozzle from which discharge failure has been detected. The defective area in the recording head 6*cl* can be specified based on, for example, the position in the sub-scanning direction in the image Im of the testing pattern where the defective line is detected, and the feed amount (the amount of movement in the sub-scanning direction) of the recording medium M when the detective line is detected.

When discharge failure of a nozzle in the recording heads 6 is detected, the image forming apparatus 100 in the present embodiment may notify the operator that discharge failure of a nozzle occurs in the recording heads 6, for example, by means of display on a not-illustrated operation panel. In this case, the maintenance mechanism 15 performs recovery operation for the recording heads 6 in accordance with the operator's operation, whereby the discharge failure of the nozzle can be eliminated.

As described above in details with reference to specific examples, the colorimetric camera 20 (an example of the nozzle testing device) in the present embodiment includes the two-dimensional image sensor 25 that captures an image of a testing pattern formed by discharging clear ink from the nozzle row 17 of the recording head 6*cl* to a recording medium M, the light source unit 31 provided such that regularly reflected light by the testing pattern enters the two-dimensional image sensor 25 to form a regular reflection area R in the image Im of the testing pattern captured by the two-dimensional image sensor 25, and the detection unit 57 that analyzes the image Im of the testing pattern to detect discharge failure of a nozzle in the recording head 6*cl*. The regular reflection area R is formed in the image Im of the testing pattern such that the dimension in the direction corresponding to the direction (main-scanning direction) of relative movement between the nozzle row 17 of the recording head 6*cl* and the recording medium M is greater than the dimension in the direction orthogonal thereto in the image Im of the testing pattern captured by the two-dimensional image sensor 25. With the colorimetric camera 20 in the present embodiment, the nozzles in the recording head 6*cl* that discharges clear ink thus can be appropriately tested for discharge failure.

With the colorimetric camera 20 in the present embodiment, the nozzles in the recording head 6*cl* can be appropriately tested for discharge failure using the image of the testing pattern captured by the two-dimensional image sensor 25, irrespective of the kind of recording medium M to form a testing pattern. For example, whether a testing pattern is formed on glossy paper with a coat layer or on plain paper without a coat layer, a defective line appears in the image of the testing pattern having a regular reflection area R, if the recording head 6*cl* that discharges clear ink has a nozzle with discharge failure. With the colorimetric camera 20 in the present embodiment, discharge failure of a nozzle in the recording head 6*cl* can be detected appropriately by the method described above, irrespective of the kind of recording medium M to form a testing pattern.

The image forming apparatus 100 in the present embodiment, which includes the colorimetric camera 20 having a function of testing for discharge failure of the nozzles in the recording heads 6 as described above, can perform recovery operation for the recording heads 6 when discharge failure of a nozzle is detected, whereby the degradation in image quality of a printed image can be suppressed.

Although specific embodiments of the present invention have been described in details above, the present invention is not limited to the foregoing embodiments as they are and can be embodied with various modifications and changes without departing from the spirit in carrying out the invention. Some of modifications to the present embodiment will be illustrated below.

First Modification

In the foregoing embodiment, the nozzles in the recording head 6*cl* that discharges clear ink are tested for discharge failure. However, the present invention is not limited to the recording head 6*cl* that discharges clear ink and can be effectively applied to, for example, testing for discharge failure of the nozzles in a recording head that discharges ink such as white ink that has low visibility when discharged on a recording medium M. A testing pattern formed by discharging white ink from the recording head to a white recording medium M has low visibility under illumination with the colorimetric light source 30, and it is difficult to test for discharge failure of the nozzles by the same method as the conventional technique. However, the nozzles in the recording head that discharges white ink can be tested for discharge failure appropriately as in the example above, by capturing an image of a testing pattern formed with white ink under illumination with the light source unit 31 (testing light sources 32) and analyzing the image Im of the testing pattern having a regular reflection area R.

Second Modification

The foregoing embodiment is an example of application to the serial head-type image forming apparatus 100 in which ink is discharged from the nozzle rows 17 of the recording heads 6 to a recording medium M to form an image while the carriage 5 with the recording heads 6 reciprocates in the main-scanning direction. The present invention, however, can also be effectively applied to a line-head type image forming apparatus in which a recording head (line head) having a nozzle row along the main-scanning direction is fixed, and ink is discharged from the nozzle row of the recording head to a recording medium to form an image while the recording medium is conveyed in the sub-scanning direction.

When the present invention is applied to the line head-type image forming apparatus, the direction of relative movement between the nozzle row and the recording medium in forming the testing pattern described above is the sub-scanning direction. The nozzle testing device is then configured such that a regular reflection area is formed such that the dimension in the direction corresponding to the sub-scanning direction is greater than the dimension in the direction corresponding to the main-scanning direction in the image of the testing pattern captured by the two-dimensional image sensor.

Figure 10:
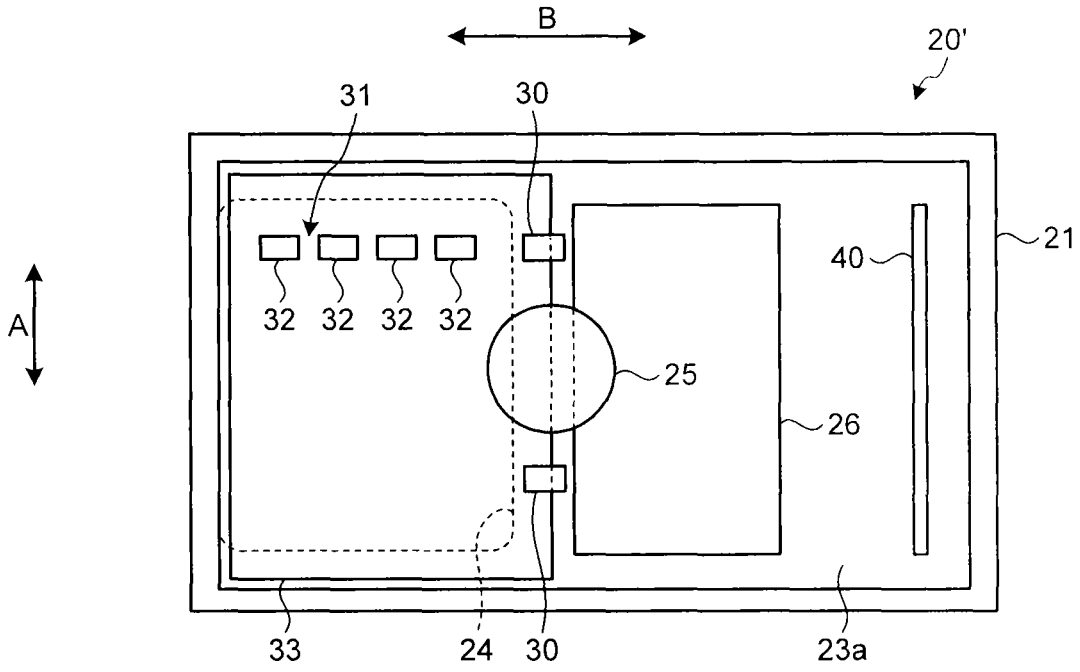
FIG. 10 illustrates the configuration of a colorimetric camera in a second modification.

When the nozzle testing device adapted for the line head-type image forming apparatus is implemented with the same configuration (hereinafter referred to as a colorimetric camera 20') as the colorimetric camera 20 in the foregoing embodiment, the colorimetric camera 20' is configured, for example, as illustrated in FIG. 10. That is, the colorimetric camera 20' is attached to, for example, the line head so as to be movable in the main-scanning direction (the direction of the arrow A in the figure). The light source unit 31 of the colorimetric camera 20' is configured to have a plurality of testing light sources 32 arranged in the inside of the housing 23 so as to be lined on a straight line along the sub-scanning direction (the direction of the arrow B in the figure) as illustrated in FIG. 10. The direction in which the testing light sources 32 are lined therefore agrees with the direction of relative movement between the recording head 6*cl* and the recording medium M in forming a testing pattern. A regular reflection area R in which regularly reflected light rays from the testing light sources 32 are lined in the main-scanning direction is then formed in the image Im of the testing pattern captured by the two-dimensional image sensor 25, whereby the nozzles in the recording head 6*cl* that discharges clear ink can be tested for discharge failure appropriately as in the foregoing embodiment.

Third Modification

In the foregoing embodiment, the nozzles in the recording heads 6*y*, 6*m*, 6*c*, 6*k* that discharge color ink are tested for discharge failure using an image of a colorimetric pattern of a single color ink captured by the two-dimensional image sensor 25 when the color of the colorimetric pattern is measured. However, a testing pattern including a first pattern formed of color ink using the recording heads 6*y*, 6*m*, 6*c*, 6*k* and a second pattern formed of clear ink (or white ink) using the recording head 6*cl* may be formed on a recording medium M, and the first pattern and the second pattern included in this testing pattern may be successively captured by the two-dimensional image sensor 25, so that the nozzles in the recording heads 6*y*, 6*m*, 6*c*, 6*k* that discharge color ink and the nozzles in the recording head 6*cl* that discharge clear ink (or white ink) may be successively tested for discharge failure.

In this case, the colorimetric camera 20 captures an image of the first pattern with the two-dimensional image sensor 25 under illumination with the colorimetric light source 30 by turning on the colorimetric light source 30 (a light source for diffuse reflection) when the opening 24 of the housing 23 reaches the position facing the first pattern included in the testing pattern with movement of the carriage 5. The colorimetric camera 20 captures an image of the second pattern with the two-dimensional imago sensor 25 under illumination with the light source unit 31 by turning on the testing light sources 32 of the light source unit 31 when the opening 24 of the housing 23 reaches the position facing the second pattern included in the testing pattern with movement of the carriage 5. The detection unit 57 then analyzes the image of the first pattern captured by the two-dimensional image sensor 25 to detect discharge failure of the nozzles that form the first pattern of color ink and analyzes the image of the second pattern captured by the two-dimensional image sensor 25 to detect discharge failure of the nozzles that form the second pattern of clear ink (or white ink). The position of the first pattern and the position of the second pattern in the testing pattern are recognized, for example, by the CPU 101 of the image forming apparatus 100, and the operation of the colorimetric camera 20 described above is performed under the control of the CPU 101.

Figure 11:
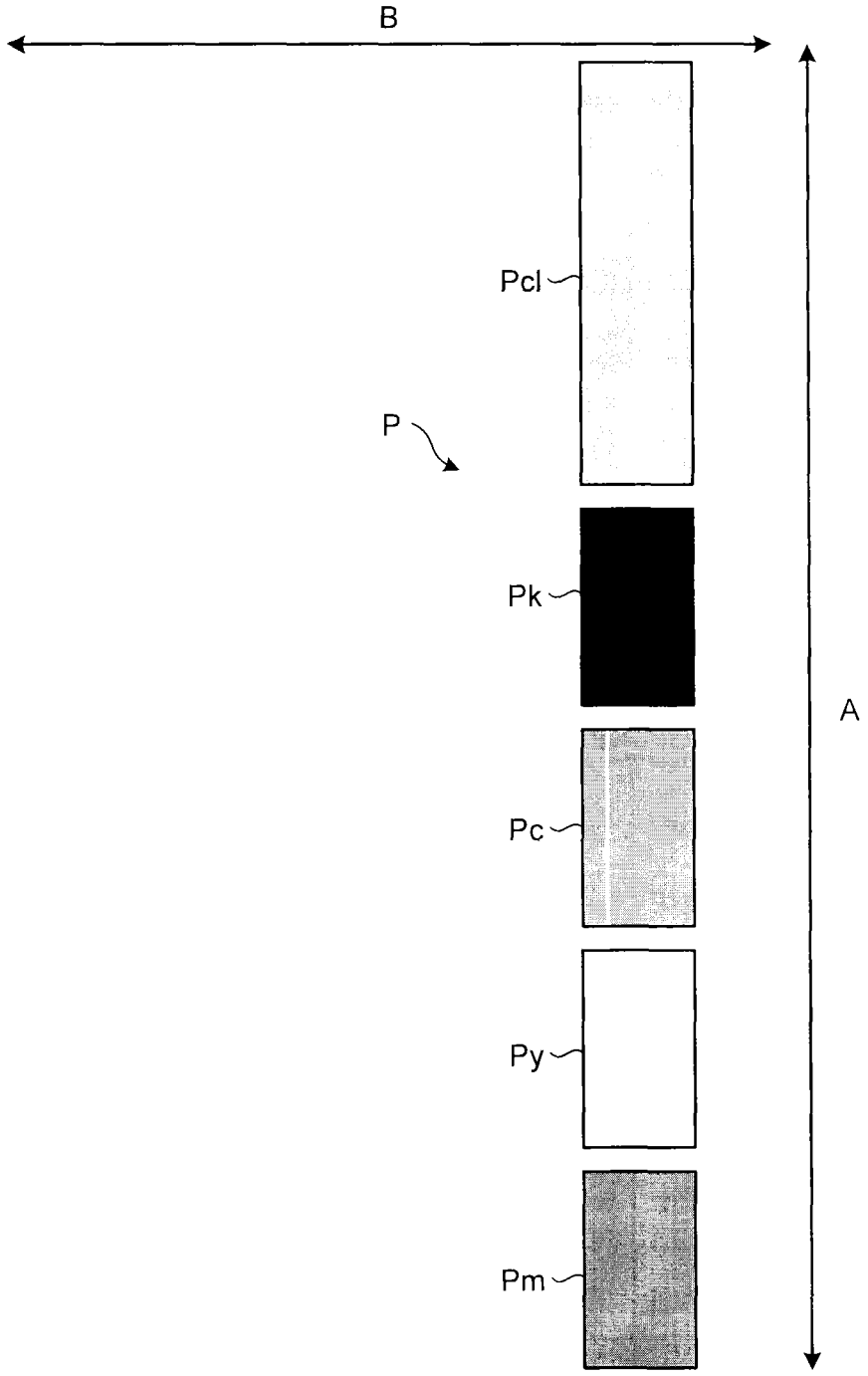
FIG. 11 illustrates an example of a testing pattern used in a third modification.

FIG. 11 illustrates an example of the testing pattern formed on a recording medium M in the present modification. A testing pattern P illustrated in FIG. 11 includes a pattern Pcl of clear ink, a pattern Pk of black ink, a pattern Pc of cyan ink, a pattern Py of yellow ink, and a pattern Pm of magenta. These patterns Pcl, Pk, Pc, Py, Pm are arranged so as to be lined in the main-scanning direction (the direction of the arrow A in the figure) that is the direction in which the carriage 5 moves (in other words, the direction in which the colorimetric camera 20 moves). In the testing pattern P formed in this manner, the pattern Pcl corresponds to the second pattern, and the patterns Pk, Pc, Py, Pm each correspond to the first pattern.

Figure 12:
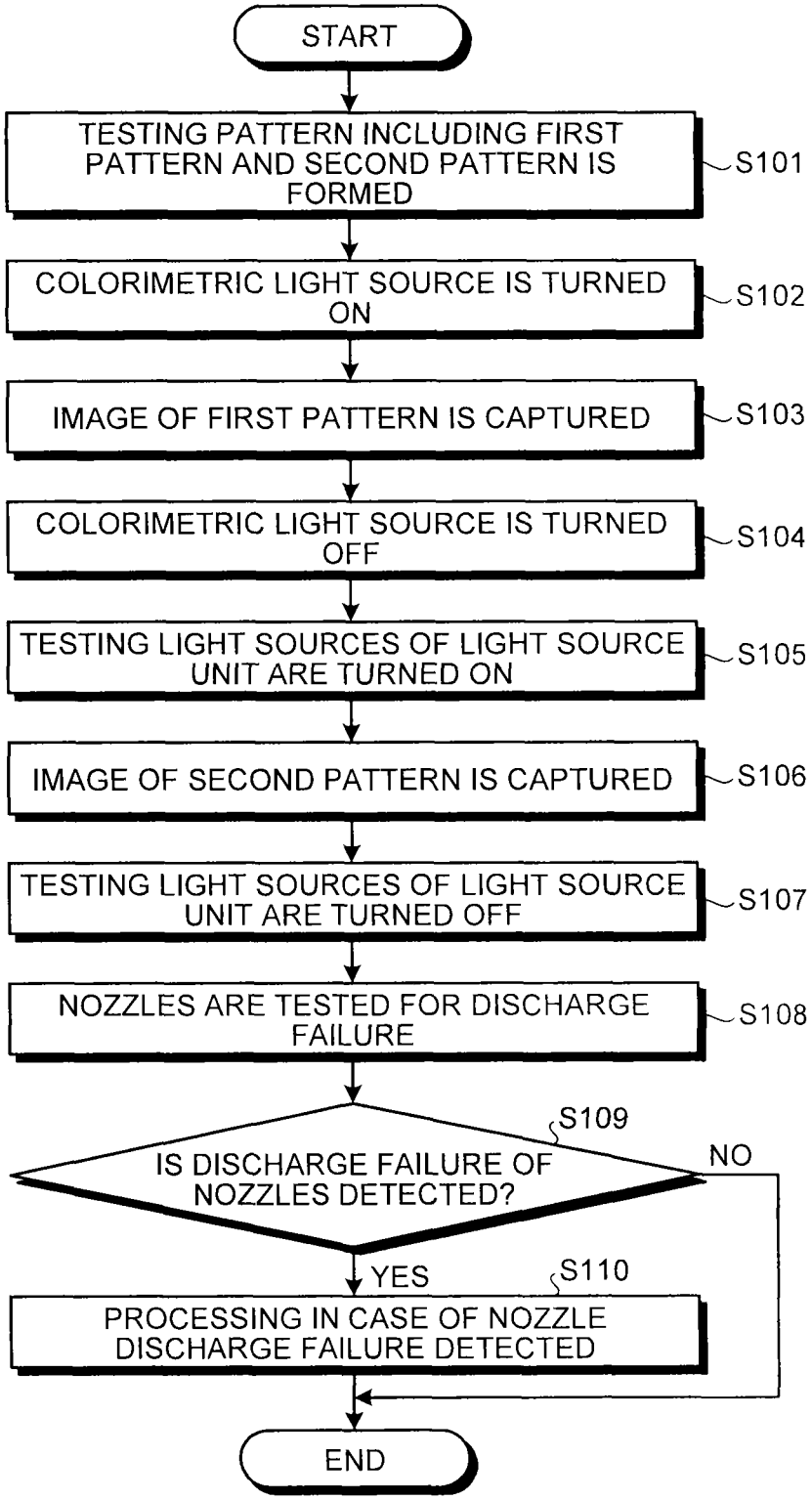
FIG. 12 is a flowchart illustrating an example of the operation in nozzle testing in the third modification.

FIG. 12 is a flowchart illustrating an example of the operation in nozzle testing in the present modification. In the present modification, first of all, a testing pattern (for example, the testing pattern P illustrated in FIG. 11) including a first pattern of color ink and a second pattern of clear ink (or white ink) is formed on a recording medium M (step S101).

Next, with the recording medium M having the testing pattern set on the platen 16, the carriage 5 is moved in the main-scanning direction, and when the opening 24 of the colorimetric camera 20 reaches the position facing the first pattern, the colorimetric light source 30 is turned on (step S102). An image of the first pattern is then captured by the two-dimensional image sensor 25 under illumination with the colorimetric light source 30 (step S103). When the testing pattern includes a plurality of first patterns of different colors (the patterns Pk, Pc, Py, Pm in FIG. 11) as in the example of the testing pattern P illustrated in FIG. 11, the two-dimensional image sensor 25 captures an image of each of the first patterns under illumination with the colorimetric light source 30. When image capturing of the first pattern by the two-dimensional image sensor 25 is finished, the colorimetric light source 30 is turned off (step S104).

Next, the testing light sources 32 of the light source unit 31 is turned on when the opening 24 of the colorimetric camera 20 reaches the position facing the second pattern (step S105). An image of the second pattern is then captured by the two-dimensional image sensor 25 under illumination with the testing light sources 32 of the light source unit 31 (step S106). When image capturing of the second pattern by the two-dimensional image sensor 25 is finished, the testing light sources 32 of the light source unit 31 are turned off (step S107).

Next, the detection unit 57 analyzes the image of the first pattern and the image of the second pattern output from the two-dimensional image sensor 25 and stored in the frame memory 52 to inspect for discharge failure of the nozzles in the recording heads 6*y*, 6*m*, 6*c*, 6*k*, 6*c*1 (step S108). If discharge failure of the nozzles is detected in at least one of the recording heads 6 (Yes at step S109), the processing in the case of nozzle discharge failure detected, such as recovery operations by the maintenance mechanism 15 and/or notification to the operator, is performed (step S110).

Fourth Modification

In the foregoing embodiment, a recording medium M is used as a recording object to form a testing pattern. However, a testing pattern may be formed on a recording object different from the recording medium M, and the image of the testing pattern formed on the recording object different from the recording medium M may be captured by the two-dimensional image sensor 25 of the colorimetric camera 20 to test for discharge failure of the nozzles. For example, Japanese Patent No. 4999505 describes an image forming apparatus in which an adjustment pattern is formed on a conveyor belt for conveying a recording medium, and a pattern reading sensor mounted on the carriage reads regularly reflected light by the adjustment pattern to detect ink displacement. The present invention can also be effectively applied to the image forming apparatus having such a configuration.

More specifically, in the image forming apparatus described in Japanese Patent No. 4999505, the aforementioned colorimetric camera 20 is mounted on the carriage, in place of the pattern reading sensor. The testing pattern described above is formed on the conveyer belt, and an image of the testing pattern is captured by the two-dimensional image sensor 25 of the colorimetric camera 20 and analyzed, whereby the nozzles in the recording head can be tested for discharge failure similarly to the foregoing embodiment. The detailed configuration of the image forming apparatus is described in Japanese Patent No. 4999505, and a description thereof is omitted.

Figure 13:
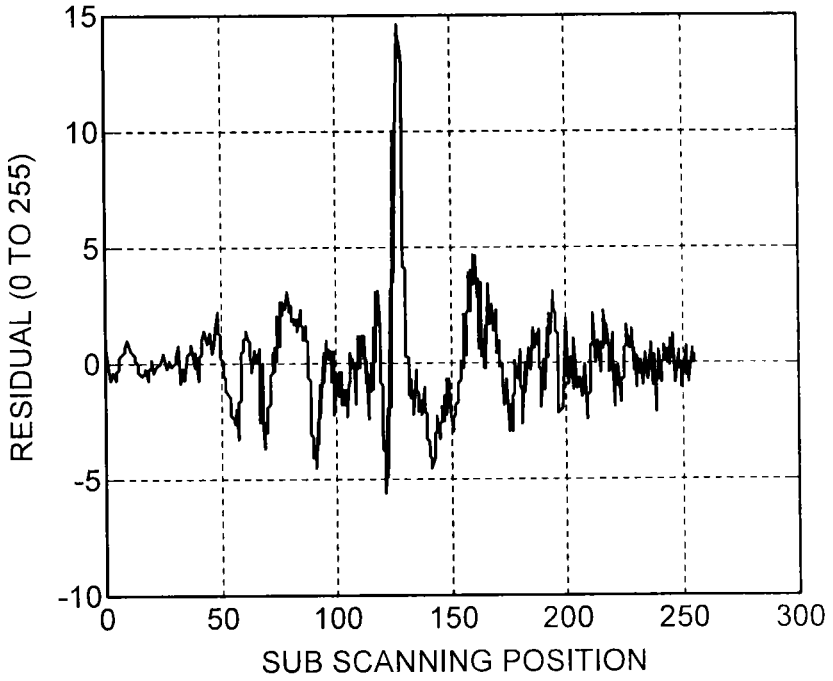
FIG. 13 illustrates an example of the analysis result of an image of a testing pattern in a fourth modification.

When a testing pattern is formed on the conveyor belt, the quantity of regularly reflected light by the exposed surface of the conveyor belt with no ink thereon is larger than that by the ink-adhering portion on the conveyor belt. In this modification, therefore, contrary to the case where a testing pattern is formed on a recording medium M, the pixel value at the sub scanning position corresponding to the position of the nozzle with discharge failure is greater than the pixel values at the neighboring sub scanning positions in the image of the testing pattern captured by the two-dimensional image sensor 25. However, as described in the foregoing embodiment, when a residual that is the difference between the pixel mean value and the approximate curve for each sub scanning position is obtained, for example, as illustrated in FIG. 13, the value (absolute value) of residual at the sub scanning position corresponding to the position of the nozzle with discharge failure is extremely large, although the sign of the value of residual is reversed when compared with the case where a testing pattern is formed on a recording medium M (see FIG. 9B). Also in this modification, discharge failure of a nozzle can be detected appropriately by comparing the residual for each sub scanning position with the threshold similarly to the foregoing embodiment.

Fifth Modification

Figure 14A:
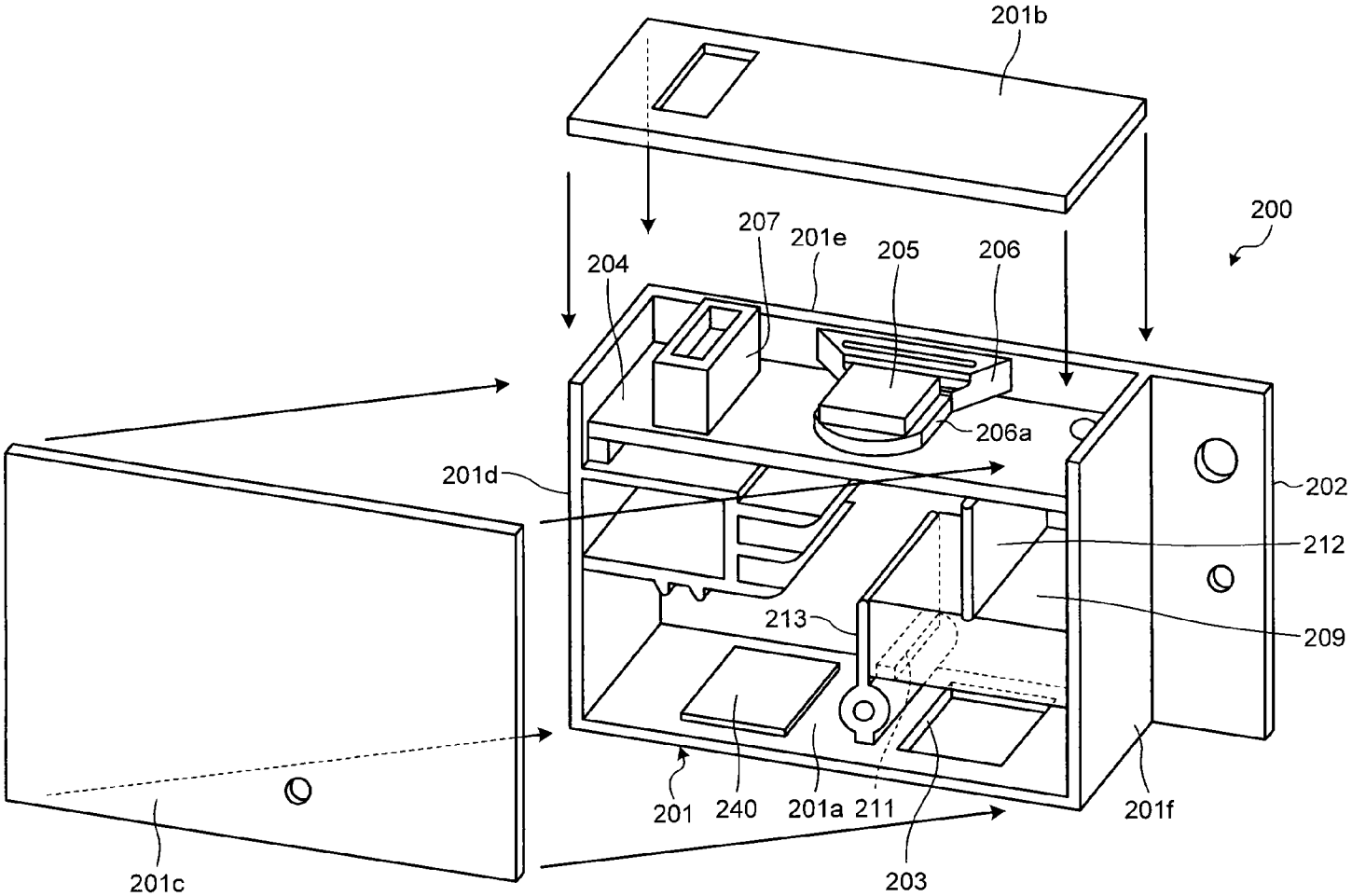
FIG. 14A is an exploded perspective view of a colorimetric camera illustrated as a fifth modification.
Figure 14B:
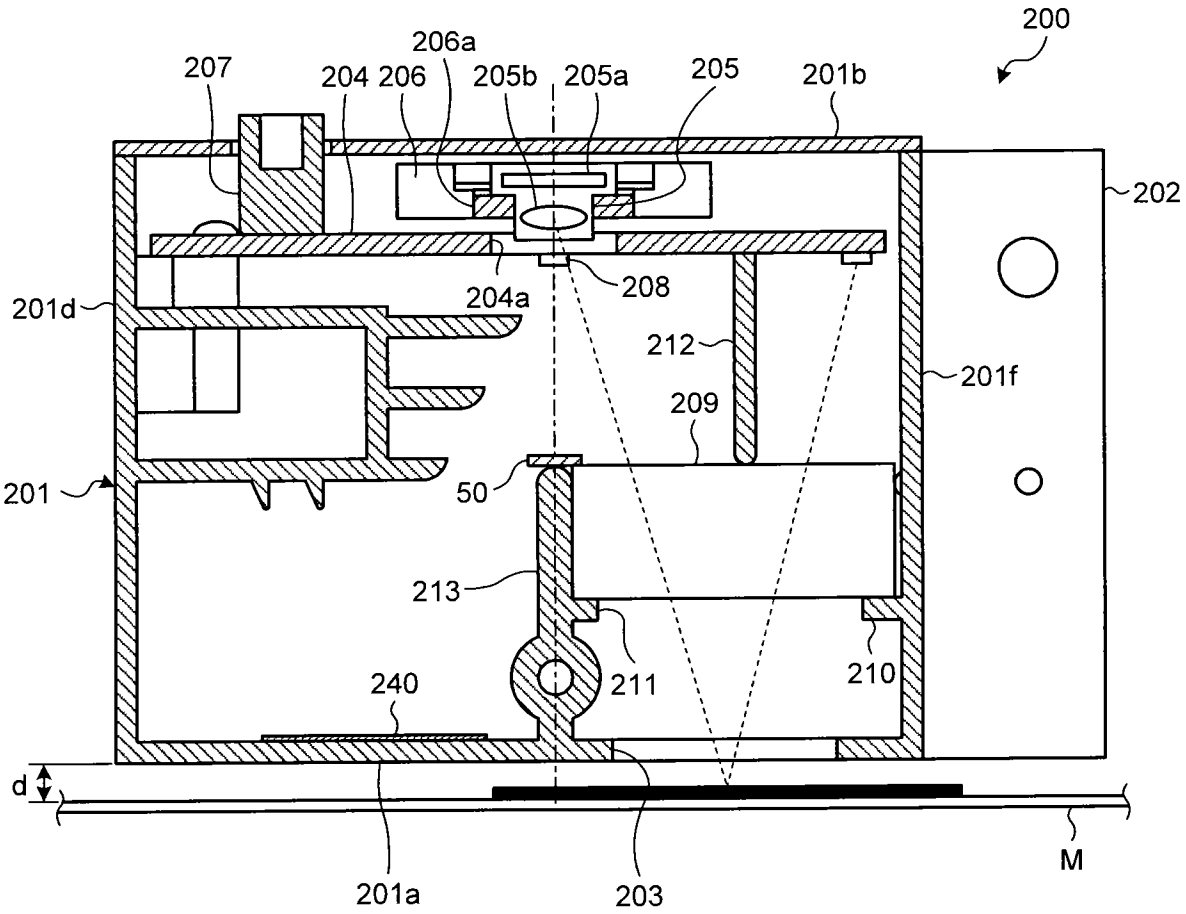
FIG. 14B is a longitudinal cross-sectional view of the colorimetric camera illustrated as the fifth modification.
Figure 14C:
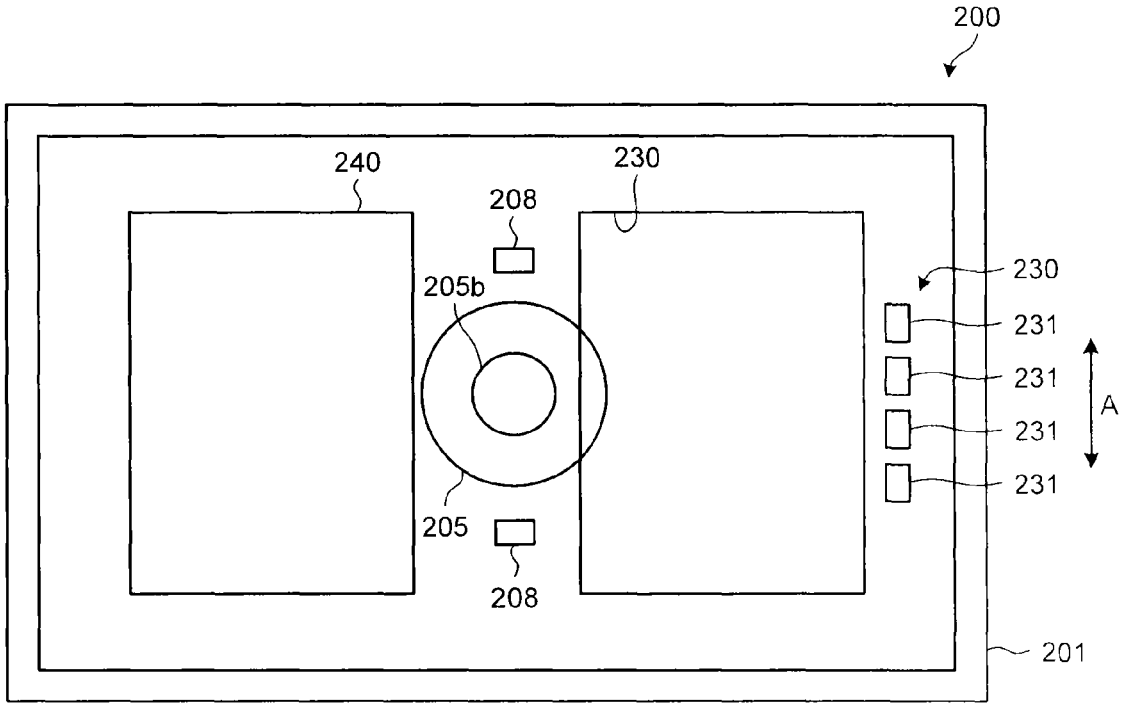
FIG. 14C is a plan view illustrating the component layout of the colorimetric camera illustrated as the fifth modification.

The foregoing embodiment is an example of application of the configuration illustrated in FIG. 4A and FIG. 4B to the colorimetric camera 20. The present invention, however, can also be effectively applied to, for example, a colorimetric camera 200 having the configuration illustrated in FIG. 14A to FIG. 14C. FIG. 14A is an exploded perspective view of the colorimetric camera 200. FIG. 14B is a longitudinal cross-sectional view of the colorimetric camera 200. FIG. 14C is a plan view illustrating the component layout of the colorimetric camera 200. The colorimetric camera 200 differs from the colorimetric camera 20 only in the mechanical configuration and has the same functions. The mechanical configuration of the colorimetric camera 200 will be described below.

As illustrated in FIG. 14A and FIG. 14B, the colorimetric camera 200 includes a housing 201 formed integrally with an attachment piece 202. The housing 201 has, for example, a bottom plate 201*a* and a top plate 201*b* facing each other with a predetermined distance, and side walls 201*c*, 201*d*, 201*e*, 201*f* connecting the bottom plate 201*a* and the top plate 201*b*. The bottom plate 201*a* and the side walls 201*d*, 201*e*, 201*f* of the housing 201 are formed integrally with the attachment piece 202, for example, by molding, whereas the top plate 201*b* and the side wall 201*c* are removable. FIG. 14A illustrates the top plate 201*b* and the side wall 201*c* in a removed state.

The colorimetric camera 200 is attached to the carriage 5, for example, by fastening the side wall 201*e* and the attachment piece 202 of the housing 201 to the side surface of the carriage 5, in abutment with the side surface of the carriage 5, using a fastening member such as a screw. As illustrated in FIG. 14B, the colorimetric camera 200 is attached to the carriage 5 such that the bottom plate 201*a* of the housing 201 faces the recording medium M on the platen 16 approximately parallel thereto with a predetermined gap d.

The bottom plate 201*a* of the housing 201 that faces the recording medium M on the platen 16 has an opening 203 (corresponding to the opening 24 of the colorimetric camera 20) for enabling the image of the colorimetric pattern or the testing pattern formed on the recording medium M to be captured from the inside of the housing 201. The inner surface of the bottom plate 201*a* of the housing 201 has a reference chart 240 (corresponding to the reference chart 40 in the colorimetric camera 20) adjacent to the opening 203 with a support member 213 interposed.

A circuit board 204 is disposed near the top plate 201*b* in the inside of the housing 201. A sensor unit 205 (corresponding to the two-dimensional image sensor 25 in the colorimetric camera 20) for capturing an image is disposed between the top plate 201*b* of the housing 201 and the circuit board 204. As illustrated in FIG. 14B, the sensor unit 205 includes an image sensor 205*a* such as a CCD sensor or a CMOS sensor and an imaging forming lens 205*b* for forming an optical image in the image capturing range of the sensor unit 205 on the light-receiving surface of the image sensor 205*a*.

The sensor unit 205 is held, for example, by a sensor holder 206 formed integrally with the side wall 201*e* of the housing 201. The sensor holder 206 has a ring 206*a* at a position facing a through hole 204*a* formed in the circuit board 204. The ring 206*a* has a through hole having a size matched with the outer shape of the protrusion of the sensor unit 205 toward the imaging forming lens 205*b*. The sensor unit 205 is held by the sensor holder 206 such that the protrusion toward the imaging forming lens 205*b* is inserted through the ring 206*a* of the sensor holder 206 so that the imaging forming lens 205*b* faces toward the bottom plate 201*a* of the housing 201 through the through hole 204*a* of the circuit board 204.

The sensor unit 205 is held so as to be positioned by the sensor holder 206 such that the optical axis denoted by the dashed and single-dotted line in FIG. 14B is approximately vertical to the bottom plate 201*a* of the housing 201 and that the opening 203 and the reference chart 240 are included in the image capturing range. The sensor unit 205 thus can capture an image of a subject outside the housing 201 through the opening 203 in a part of the image capturing area and can capture an image of the reference chart 240 in another part of the image capturing area.

The sensor unit 205 is electrically connected to the circuit board 204 having various electronics mounted thereon, for example, through a flexible cable. The circuit board 204 has a connector 207 for external connection to which a connection cable is attached for connecting the colorimetric camera 200 to the main control board 120 (see FIG. 6) of the image forming apparatus 100.

In the inside of the housing 201, a colorimetric light source 208 (corresponding to the colorimetric light source 30 in the colorimetric camera 20) is provided for illuminating at least the image capturing area of the sensor unit 205 generally uniformly with diffuse light.

In the inside of the housing 201, an optical length changing member 209 is disposed in the optical path between the sensor unit 205 and a subject outside the housing 201 whose image is captured by the sensor unit 205 through the opening 203. The optical length changing member 209 is an optical element with a refractive index n having a sufficient transmittance for light (illumination light) from the colorimetric light source 208. The optical length changing member 209 has a function of bringing the imaging forming plane of the optical image of the subject outside the housing 201 closer to the imaging forming plane of the optical image of the reference chart 240 inside the housing 201. That is, in the colorimetric camera 200 in this modification, the optical length changing member 209 is disposed in the optical path between the sensor unit 205 and the subject outside the housing 201 to change the optical length so that the imaging forming plane of the optical image of the subject outside the housing 201 and the imaging forming plane of the reference chart 240 inside the housing 201 are both matched with the light-receiving surface of the image sensor 205*a* of the sensor unit 205. The sensor unit 205 thus can capture an image focused on both the subject outside the housing 201 and the reference chart 240 inside the housing 201.

As illustrated in FIG. 14A and FIG. 14B, for example, the optical length changing member 209 is supported by a pair of ribs 210 and 211 at both ends of the surface closer to the bottom plate 201*a*. A pressing member 212 is disposed between the surface of the optical length changing member 209 facing the top plate 201*b* and the circuit board 204 so that the optical length changing member 209 does not move in the housing 201. The optical length changing member 209, which is disposed so as to close the opening 203 at the bottom plate 201*a* of the housing 201, has a function of preventing impurities such as ink mist and dust intruding into the housing 201 from the outside of the housing 201 through the opening 203 from adhering to the sensor unit 205, the illumination light source 208, the reference chart 240, and other components (this function corresponds to the cover member 33 of the colorimetric camera 20).

In the inside of the housing 201, a light source unit 230 (corresponding to the light source unit 31 in the colorimetric camera 20) is provided for emitting light to the testing pattern formed on the recording medium M when the nozzles in the recording head 6*cl* that discharges clear ink (or white ink) are tested for discharge failure. The light source unit 230 is provided such that light emitted from the light source unit 230 and regularly reflected by the testing pattern enters the sensor unit 205 to form a regular reflection area in the image of the testing pattern captured by the sensor unit 205, similarly to the light source unit 31 in the colorimetric camera 20.

In the colorimetric camera 200 in the present modification, the regular reflection area is formed so as to be elongated in the main-scanning direction that is the direction of relative movement between the recording head 6*cl* and the recording medium M in forming a testing pattern, in the image of the testing pattern captured by the sensor unit 205. That is, the light source unit 230 is configured such that a regular reflection area shaped such that the length in the main-scanning direction is greater than the length in the sub-scanning direction is formed in the image of the testing pattern.

As illustrated in FIG. 14C, for example, the light source unit 230 is configured to have a plurality of testing light sources 231 (corresponding to the testing light sources 32 in the colorimetric camera 20) disposed in the inside of the housing 201 so as to be lined on a straight line along the main-scanning direction (the direction of the arrow A in the figure). For example, LEDs are used as the testing light sources 231. Since the colorimetric camera 200 is fixed to the carriage 5 with the recording heads 6, the direction in which the testing light sources 231 are lined agrees with the direction of relative movement between the recording head 6*cl* and the recording medium M in forming a testing pattern. A regular reflection area in which regularly reflected light rays from the testing light sources 231 are arranged in the main-scanning direction is thus formed in the image of the testing pattern captured by the sensor unit 205.

The light source unit 230 may have any configuration that can form a regular reflection area longer in the main-scanning direction than in the sub-scanning direction in the image of the testing pattern captured by the sensor unit 205. For example, the light source unit 230 may be configured with a single testing light source that forms a strip-like regular reflection area elongated in the main-scanning direction.

The colorimetric camera 200 in the present modification captures an image of the colorimetric pattern with the sensor unit 205, with the colorimetric light source 208 turned on, during color measurement of the colorimetric pattern and during nozzle testing in the recording heads 6*y*, 6*m*, 6*c*, 6*k* that discharge color ink. On the other hand, during nozzle testing in the recording head 6*cl* that discharges clear ink, an image of the testing pattern is captured with the sensor unit 205, with the testing light sources 231 of the light source unit 230 turned on. The image of the testing pattern having a regular reflection area is then analyzed to detect discharge failure of a nozzle in the recording head 6*cl*.

An embodiment provides an advantageous effect that the nozzles that discharge ink such as clear ink and white ink that have low visibility after being discharged can be appropriately tested for discharge failure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A nozzle testing device comprising:

a two-dimensional image sensor to capture an image of a pattern formed on a recording object by discharging ink from a nozzle row including a plurality of nozzles while moving the nozzle row relative to the recording object in a first direction orthogonal to a second direction in which the plurality of nozzles of the nozzle row are arranged, or moving the recording object relative to the nozzle row in the first direction;

a light source provided such that regularly reflected light by the pattern enters the two-dimensional image sensor and forms a regular reflection area in the image of the pattern captured by the two-dimensional image sensor; and detection circuitry to analyze the image to detect discharge failure of the nozzles, wherein the regular reflection area is formed in the image such that a dimension in a direction corresponding to the first direction is greater than a dimension in a direction corresponding to the second direction.

2. The nozzle testing device according to claim 1, wherein the light source includes a plurality of light sources, and the regular reflection area is formed in the image such that regularly reflected light rays from the light sources are lined in the direction corresponding to the first direction.

3. The nozzle testing device according to claim 1, further comprising an optical member disposed in an optical path of light emitted from the light source to the pattern, wherein the light source is provided such that regularly reflected light by the pattern enters the two-dimensional image sensor and regularly reflected light by the optical member does not enter the two-dimensional image sensor.

4. The nozzle testing device according to claim 1, further comprising:

an optical member disposed in an optical path of light emitted from the light source to the pattern; and a light-shielding member to block regularly reflected light by the optical member to prevent the regularly reflected light from entering the two-dimensional image sensor.

5. The nozzle testing device according to claim 1, wherein the pattern is formed on the recording object by discharging ink from the nozzle row while moving the nozzle row in a main-scanning direction being the first direction, and the regular reflection area is formed in the image such that a dimension in a direction corresponding to the main-scanning direction is greater than a dimension corresponding to a sub-scanning direction that is the second direction and is a direction orthogonal to the main-scanning direction in the image.

6. The nozzle testing device according to claim 1, wherein the pattern is formed on the recording object by discharging ink from the nozzle row while moving the recording object in a sub-scanning direction being the first direction, and the regular reflection area is formed in the image such that a dimension in a direction corresponding to the sub-scanning direction is greater than a dimension corresponding to a main-scanning direction that is the second direction and is a direction orthogonal to the sub-scanning direction in the image.

7. The nozzle testing device according to claim 1, wherein the recording object is a conveyor belt that conveys a recording medium.

8. The nozzle testing device according to claim 1, wherein the pattern is formed using clear ink having a transparency higher than that of color ink.

9. The nozzle testing device according to claim 1, wherein the pattern includes a first pattern formed using color ink and a second pattern formed using clear ink having a transparency higher than that of the color ink, the nozzle testing device further comprises a light source for diffuse reflection provided such that diffusely reflected light by the first pattern enters the two-dimensional image sensor, and the detection circuitry analyze an image of the first pattern captured by the two-dimensional image sensor under illumination with the light source for diffuse reflection to detect discharge failure of the nozzles that form the first pattern and also analyze an image of the second pattern captured by the two-dimensional image sensor under illumination with the light source to detect discharge failure of the nozzles that form the second pattern.

10. An image forming apparatus comprising the nozzle testing device of claim 1.

* * * * *